US007886497B2

(12) United States Patent
Pervan

(10) Patent No.: US 7,886,497 B2
(45) Date of Patent: Feb. 15, 2011

(54) FLOORBOARD, SYSTEM AND METHOD FOR FORMING A FLOORING, AND A FLOORING FORMED THEREOF

(75) Inventor: Darko Pervan, Viken (SE)

(73) Assignee: Valinge Innovation AB, Vilken (SE)

( * ) Notice: Subject to any disclaimer, the term of this patent is extended or adjusted under 35 U.S.C. 154(b) by 929 days.

(21) Appl. No.: 11/000,912

(22) Filed: Dec. 2, 2004

(65) Prior Publication Data

US 2005/0210810 A1 Sep. 29, 2005

Related U.S. Application Data

(60) Provisional application No. 60/527,771, filed on Dec. 9, 2003.

(30) Foreign Application Priority Data

Dec. 2, 2003 (SE) ..... 0303273

(51) Int. Cl.
*E04B 2/00* (2006.01)

(52) U.S. Cl. ..... 52/588.1; 52/592.1; 52/747.1

(58) Field of Classification Search ..... 52/578, 52/536, 539, 588.1, 592.1, 592.2, 591.3, 52/581, 747.1
See application file for complete search history.

(56) References Cited

U.S. PATENT DOCUMENTS

| | | | |
|---|---|---|---|
| 168,672 | A | 10/1875 | Frank |
| 213,740 | A | 4/1879 | Conner |
| 714,987 | A | 12/1902 | Wolfe |
| 753,791 | A | 3/1904 | Fulghum |
| 1,124,228 | A | 1/1915 | Houston |
| 1,194,636 | A | 8/1916 | Joy |
| 1,371,856 | A | 3/1921 | Cade |
| 1,407,679 | A | 2/1922 | Ruthrauff |
| 1,454,250 | A | 5/1923 | Parsons |
| 1,468,288 | A | 9/1923 | Een |
| 1,477,813 | A | 12/1923 | Daniels et al. |

(Continued)

FOREIGN PATENT DOCUMENTS

AT 218725 B 12/1961

(Continued)

OTHER PUBLICATIONS

U.S. Appl. No. 10/908,658; Pervan, filed May 20, 2005.
Jacobsson, Jan, U.S. Appl. No. 11/635,631, entitled "Floor Light", filed Dec. 8, 2006.
Pervan, Darko, et al., U.S. Appl. No. 11/635,674, entitled "Laminate Floor Panels", filed Dec. 8, 2006.

(Continued)

*Primary Examiner*—Richard E Chilcot, Jr.
*Assistant Examiner*—Jessica Laux
(74) *Attorney, Agent, or Firm*—Buchanan Ingersoll & Rooney PC

(57) ABSTRACT

A system for forming a flooring includes rectangular floorboards (1, 1') including first and second types of floorboards (A, B), on which first and second locking devices are arranged in pairs on opposing short edges (5*a*, 5*b*) and long edges (4*a*, 4*b*), respectively, and on which the locking device of the first type of floorboard (A) along one pair of opposing joint edges is mirror inverted relative to the corresponding locking device along the same pair of opposing joint edges of the second type of floorboard (B). The system includes a third type of floorboard (C), which is so designed that a first one (5*b*) of its two short edges presents the first locking device (12) and both its long edges (4*a*, 4*b*) and its other short edge (5*a*) presents the second locking device.

16 Claims, 7 Drawing Sheets

U.S. PATENT DOCUMENTS

| | | | | | |
|---|---|---|---|---|---|
| 1,510,924 | A | | 10/1924 | Daniels et al. | |
| 1,540,128 | A | | 6/1925 | Houston | |
| 1,575,821 | A | | 3/1926 | Daniels | |
| 1,602,256 | A | | 10/1926 | Sellin | |
| 1,602,267 | A | | 10/1926 | Karwisch | |
| 1,615,096 | A | | 1/1927 | Meyers | |
| 1,622,103 | A | | 3/1927 | Fulton | |
| 1,622,104 | A | | 3/1927 | Fulton | |
| 1,637,634 | A | | 8/1927 | Carter | |
| 1,644,710 | A | | 10/1927 | Crooks | |
| 1,660,480 | A | | 2/1928 | Daniels | |
| 1,714,738 | A | | 5/1929 | Smith | |
| 1,718,702 | A | | 6/1929 | Pfiester | |
| 1,734,826 | A | | 11/1929 | Pick | |
| 1,764,331 | A | | 6/1930 | Moratz | |
| 1,778,069 | A | | 10/1930 | Fetz | |
| 1,787,027 | A | | 12/1930 | Wasleff | |
| 1,790,178 | A | | 1/1931 | Sutherland, Jr. | |
| 1,823,039 | A | | 9/1931 | Gruner | |
| 1,843,024 | A | | 1/1932 | Fetz | |
| 1,859,667 | A | | 5/1932 | Gruner | |
| 1,809,393 | A | | 6/1932 | Rockwell | |
| 1,898,364 | A | | 2/1933 | Gynn | |
| 1,906,411 | A | | 5/1933 | Potvin | |
| 1,925,070 | A | * | 8/1933 | Livezey | 52/747.1 |
| 1,929,871 | A | | 10/1933 | Jones | |
| 1,940,377 | A | | 12/1933 | Storm | |
| 1,953,306 | A | | 4/1934 | Moratz | |
| 1,986,739 | A | | 1/1935 | Mitte | |
| 1,988,201 | A | | 1/1935 | Hall | |
| 2,015,813 | A | * | 10/1935 | Nielsen | 52/390 |
| 2,026,511 | A | | 12/1935 | Storm | |
| 2,044,216 | A | | 6/1936 | Klages | |
| 2,088,238 | A | * | 7/1937 | Ray | 52/390 |
| 2,089,075 | A | * | 8/1937 | Siebs | 52/506.01 |
| 2,266,464 | A | | 12/1941 | Kraft | |
| 2,276,071 | A | | 3/1942 | Scull | |
| 2,303,745 | A | * | 12/1942 | Karreman | 52/592.1 |
| 2,324,628 | A | | 7/1943 | Kähr | |
| 2,398,632 | A | | 4/1946 | Frost et al. | |
| 2,430,200 | A | | 11/1947 | Wilson | |
| 2,495,862 | A | | 1/1950 | Osborn | |
| 2,497,837 | A | | 2/1950 | Nelson | |
| 2,740,167 | A | | 4/1956 | Rowley | |
| 2,780,253 | A | | 2/1957 | Joa | |
| 2,851,740 | A | | 9/1958 | Baker | |
| 2,865,058 | A | | 12/1958 | Andersson et al. | |
| 2,894,292 | A | | 7/1959 | Gramelspacher | |
| 2,947,040 | A | | 8/1960 | Schultz | |
| 3,045,294 | A | | 7/1962 | Livezey, Jr. | |
| 3,100,556 | A | | 8/1963 | De Ridder | |
| 3,120,083 | A | | 2/1964 | Dahlberg et al. | |
| 3,125,138 | A | | 3/1964 | Bolenbach | |
| 3,182,769 | A | | 5/1965 | De Ridder | |
| 3,200,553 | A | | 8/1965 | Frashour et al. | |
| 3,203,149 | A | | 8/1965 | Soddy | |
| 3,247,638 | A | | 4/1966 | Gay | |
| 3,267,630 | A | | 8/1966 | Omholt | |
| 3,282,010 | A | | 11/1966 | King, Jr. | |
| 3,301,147 | A | | 1/1967 | Clayton et al. | |
| 3,310,919 | A | | 3/1967 | Bue et al. | |
| 3,347,048 | A | | 10/1967 | Brown et al. | |
| 3,377,931 | A | | 4/1968 | Hilton | |
| 3,387,422 | A | | 6/1968 | Wanzer | |
| 3,436,888 | A | * | 4/1969 | Ottosson | 52/480 |
| 3,460,304 | A | | 8/1969 | Braeuninger et al. | |
| 3,481,810 | A | | 12/1969 | Waite | |
| 3,508,523 | A | | 4/1970 | De Meerleer | |
| 3,526,420 | A | | 9/1970 | Brancalcone | |
| 3,538,665 | A | | 11/1970 | Gohner | |
| 3,548,559 | A | | 12/1970 | Levine | |
| 3,553,919 | A | | 1/1971 | Omholt | |
| 3,554,850 | A | * | 1/1971 | Kuhle | 52/392 |
| 3,555,762 | A | | 1/1971 | Costanzo, Jr. | |
| 3,579,941 | A | | 5/1971 | Tibbals | |
| 3,694,983 | A | | 10/1972 | Couquet | |
| 3,714,747 | A | | 2/1973 | Curran | |
| 3,731,445 | A | | 5/1973 | Hoffmann et al. | |
| 3,759,007 | A | | 9/1973 | Thiele | |
| 3,768,846 | A | | 10/1973 | Hensley et al. | |
| 3,786,608 | A | | 1/1974 | Boettcher | |
| 3,842,562 | A | | 10/1974 | Daigle | |
| 3,857,749 | A | | 12/1974 | Yoshida | |
| 3,859,000 | A | | 1/1975 | Webster | |
| 3,902,293 | A | | 9/1975 | Witt et al. | |
| 3,908,053 | A | | 9/1975 | Hettich | |
| 3,916,965 | A | | 11/1975 | Attridge et al. | |
| 3,936,551 | A | | 2/1976 | Elmendorf et al. | |
| 3,988,187 | A | | 10/1976 | Witt et al. | |
| 4,037,377 | A | | 7/1977 | Howell et al. | |
| 4,084,996 | A | | 4/1978 | Wheeler | |
| 4,090,338 | A | | 5/1978 | Bourgade | |
| 4,099,358 | A | | 7/1978 | Compaan | |
| 4,100,710 | A | | 7/1978 | Kowallik | |
| 4,169,688 | A | | 10/1979 | Toshio | |
| 4,219,056 | A | | 8/1980 | Lindstrom | |
| 4,227,430 | A | | 10/1980 | Jansson et al. | |
| 4,230,163 | A | | 10/1980 | Barton | |
| 4,242,390 | A | | 12/1980 | Nemeth | |
| 4,281,696 | A | | 8/1981 | Howard et al. | |
| 4,299,070 | A | | 11/1981 | Oltmanns et al. | |
| 4,304,083 | A | | 12/1981 | Anderson | |
| 4,426,820 | A | | 1/1984 | Terbrack et al. | |
| 4,471,012 | A | | 9/1984 | Maxwell | |
| 4,489,115 | A | | 12/1984 | Layman et al. | |
| 4,501,102 | A | | 2/1985 | Knowles | |
| 4,561,233 | A | | 12/1985 | Harter et al. | |
| 4,567,706 | A | | 2/1986 | Wendt | |
| 4,612,074 | A | | 9/1986 | Smith et al. | |
| 4,612,745 | A | | 9/1986 | Hovde | |
| 4,641,469 | A | | 2/1987 | Wood | |
| 4,643,237 | A | | 2/1987 | Rosa | |
| 4,646,494 | A | | 3/1987 | Saarinen et al. | |
| 4,648,165 | A | | 3/1987 | Whitehorne | |
| 4,653,242 | A | | 3/1987 | Ezard | |
| 4,703,597 | A | | 11/1987 | Eggemar | |
| 4,715,162 | A | | 12/1987 | Brightwell | |
| 4,716,700 | A | | 1/1988 | Hagemeyer | |
| 4,738,071 | A | | 4/1988 | Ezard | |
| 4,769,963 | A | | 9/1988 | Meyerson | |
| 4,819,932 | A | | 4/1989 | Trotter, Jr. | |
| 4,822,440 | A | | 4/1989 | Hsu et al. | |
| 4,831,806 | A | | 5/1989 | Niese et al. | |
| 4,845,907 | A | | 7/1989 | Meek | |
| 4,905,442 | A | | 3/1990 | Daniels | |
| 4,930,386 | A | | 6/1990 | Laskowski et al. | |
| 5,029,425 | A | | 7/1991 | Bogataj | |
| 5,113,632 | A | | 5/1992 | Hanson | |
| 5,117,603 | A | | 6/1992 | Weintraub | |
| 5,148,850 | A | | 9/1992 | Urbanick | |
| 5,165,816 | A | | 11/1992 | Parasin | |
| 5,179,812 | A | | 1/1993 | Hill | |
| 5,213,861 | A | | 5/1993 | Severson et al. | |
| 5,216,861 | A | | 6/1993 | Meyerson | |
| 5,253,464 | A | | 10/1993 | Nilsen | |
| 5,271,564 | A | | 12/1993 | Smith | |
| 5,286,545 | A | | 2/1994 | Simmons, Jr. | |
| 5,295,341 | A | | 3/1994 | Kajiwara | |
| 5,349,796 | A | * | 9/1994 | Meyerson | 52/309.11 |
| 5,390,457 | A | | 2/1995 | Sjölander | |
| 5,425,986 | A | | 6/1995 | Guyette | |
| 5,433,806 | A | | 7/1995 | Pasquali et al. | |
| 5,474,831 | A | | 12/1995 | Nystrom | |
| 5,497,589 | A | | 3/1996 | Porter | |

5,502,939 A 4/1996 Zadok et al.
5,540,025 A 7/1996 Takehara et al.
5,560,569 A 10/1996 Schmidt
5,567,497 A 10/1996 Zegler et al.
5,570,554 A 11/1996 Searer
5,597,024 A 1/1997 Bolyard et al.
5,613,894 A 3/1997 Delle Vedove
5,618,602 A 4/1997 Nelson
5,630,304 A 5/1997 Austin
5,653,099 A 8/1997 MacKenzie
5,671,575 A 9/1997 Wu
5,695,875 A 12/1997 Larsson et al.
5,706,621 A 1/1998 Pervan
5,755,068 A 5/1998 Ormiston
5,768,850 A 6/1998 Chen
5,797,237 A 8/1998 Finkell, Jr.
5,823,240 A 10/1998 Bolyard et al.
5,827,592 A 10/1998 Van Gulik et al.
5,860,267 A 1/1999 Pervan
5,899,038 A 5/1999 Stroppiana
5,899,251 A 5/1999 Turner
5,900,099 A 5/1999 Sweet et al.
5,925,211 A 7/1999 Rakauskas
5,935,668 A 8/1999 Smith
5,943,239 A 8/1999 Shamblin et al.
5,954,915 A 9/1999 Voorhees et al.
5,968,625 A 10/1999 Hudson
5,987,839 A 11/1999 Hamar et al.
6,006,486 A 12/1999 Moriau et al.
6,023,907 A 2/2000 Pervan
6,029,416 A 2/2000 Andersson
6,094,882 A 8/2000 Pervan
6,101,778 A 8/2000 Martensson
6,119,423 A 9/2000 Costantino
6,134,854 A 10/2000 Stanchfield
6,148,884 A 11/2000 Bolyard et al.
6,173,548 B1 1/2001 Hamar et al.
6,182,410 B1 2/2001 Pervan
6,189,283 B1 2/2001 Bentley
6,203,653 B1 3/2001 Seidner
6,205,639 B1 3/2001 Pervan
6,209,278 B1 4/2001 Tychsen
6,216,403 B1 4/2001 Belbeoc'h
6,216,409 B1 4/2001 Roy et al.
6,226,951 B1 5/2001 Azar
6,247,285 B1 6/2001 Mobeus
6,314,701 B1 11/2001 Meyerson
6,324,803 B1 12/2001 Pervan
6,332,733 B1 12/2001 Hamberger et al.
6,339,908 B1 1/2002 Chuang
6,345,481 B1 2/2002 Nelson
6,363,677 B1 4/2002 Chen et al.
6,385,936 B1 5/2002 Schneider
6,397,547 B1 6/2002 Martensson
6,421,970 B1 7/2002 Martensson et al.
6,438,919 B1 8/2002 Knauseder
6,446,405 B1 9/2002 Pervan
6,490,836 B1 12/2002 Moriau et al.
6,497,079 B1 12/2002 Pletzer et al.
6,505,452 B1 1/2003 Hannig et al.
6,510,665 B2 1/2003 Pervan
6,516,579 B1 2/2003 Pervan
6,526,719 B2 3/2003 Pletzer et al.
6,532,709 B2 3/2003 Pervan
6,536,178 B1 3/2003 Palsson et al.
6,584,747 B2 7/2003 Kettler et al.
6,601,359 B2 8/2003 Olofsson
6,606,834 B2 8/2003 Martensson et al.
6,647,689 B2 11/2003 Pletzer et al.
6,647,690 B1 11/2003 Martensson
6,670,019 B2 12/2003 Andersson
6,672,030 B2 1/2004 Schulte
6,684,592 B2 2/2004 Martin
6,711,869 B2 * 3/2004 Tychsen ..... 52/747.11
6,715,253 B2 4/2004 Pervan
6,722,809 B2 4/2004 Hamberger et al.
6,729,091 B1 * 5/2004 Martensson ..... 52/391
6,763,643 B1 7/2004 Martensson
6,769,218 B2 8/2004 Pervan
6,769,219 B2 8/2004 Schwitte et al.
6,786,019 B2 9/2004 Thiers
6,851,237 B2 * 2/2005 Niese et al. ..... 52/480
6,851,241 B2 2/2005 Pervan
6,862,857 B2 3/2005 Tychsen
6,874,292 B2 4/2005 Moriau et al.
6,880,305 B2 * 4/2005 Pervan et al. ..... 52/480
6,898,913 B2 * 5/2005 Pervan ..... 52/589.1
6,918,220 B2 * 7/2005 Pervan ..... 52/578
6,922,964 B2 * 8/2005 Pervan ..... 52/551
6,933,043 B1 8/2005 Son et al.
7,003,925 B2 2/2006 Pervan
7,022,189 B2 4/2006 Delle Vedove
7,051,486 B2 * 5/2006 Pervan ..... 52/586.1
7,070,370 B2 7/2006 Brooks
7,086,205 B2 * 8/2006 Pervan ..... 52/403.1
D528,671 S * 9/2006 Grafenauer ..... D25/138
7,127,860 B2 * 10/2006 Pervan et al. ..... 52/592.1
7,137,229 B2 11/2006 Pervan
7,171,791 B2 2/2007 Pervan
7,275,350 B2 * 10/2007 Pervan et al. ..... 52/592.1
7,328,536 B2 * 2/2008 Moriau et al. ..... 52/588.1
7,356,971 B2 * 4/2008 Pervan ..... 52/578
7,386,963 B2 * 6/2008 Pervan ..... 52/589.1
7,398,625 B2 * 7/2008 Pervan ..... 52/578
2001/0029720 A1 10/2001 Pervan
2002/0007608 A1 * 1/2002 Pervan ..... 52/578
2002/0007609 A1 * 1/2002 Pervan ..... 52/590.2
2002/0014047 A1 2/2002 Thiers
2002/0020127 A1 2/2002 Thiers et al.
2002/0031646 A1 3/2002 Chen et al.
2002/0046528 A1 4/2002 Pervan et al.
2002/0056245 A1 * 5/2002 Thiers ..... 52/589.1
2002/0069611 A1 6/2002 Leopolder
2002/0083673 A1 * 7/2002 Kettler et al. ..... 52/578
2002/0092263 A1 * 7/2002 Schulte ..... 52/747.1
2002/0095894 A1 * 7/2002 Pervan ..... 52/391
2002/0100231 A1 8/2002 Miller et al.
2002/0112429 A1 * 8/2002 Niese et al. ..... 52/392
2002/0112433 A1 * 8/2002 Pervan ..... 52/592.1
2002/0170257 A1 * 11/2002 McLain et al. ..... 52/539
2002/0178673 A1 12/2002 Pervan
2002/0178674 A1 12/2002 Pervan
2002/0178682 A1 12/2002 Pervan
2003/0009972 A1 1/2003 Pervan et al.
2003/0024199 A1 2/2003 Pervan et al.
2003/0024200 A1 * 2/2003 Moriau et al. ..... 52/592.1
2003/0033777 A1 2/2003 Thiers et al.
2003/0033784 A1 2/2003 Pervan
2003/0041545 A1 3/2003 Stanchfield
2003/0084636 A1 5/2003 Pervan
2003/0101674 A1 * 6/2003 Pervan et al. ..... 52/592.1
2003/0115812 A1 6/2003 Pervan
2003/0115821 A1 6/2003 Pervan
2003/0196397 A1 * 10/2003 Niese et al. ..... 52/392
2003/0196405 A1 * 10/2003 Pervan ..... 52/592.1
2003/0221387 A1 12/2003 Shah
2003/0233809 A1 12/2003 Pervan
2004/0016196 A1 1/2004 Pervan
2004/0035078 A1 2/2004 Pervan
2004/0035079 A1 2/2004 Evjen
2004/0045254 A1 3/2004 Van der Heijden
2004/0068954 A1 * 4/2004 Martensson ..... 52/592.1
2004/0139678 A1 7/2004 Pervan
2004/0177584 A1 9/2004 Pervan
2004/0206036 A1 10/2004 Pervan
2004/0241374 A1 12/2004 Thiers et al.

| | | | | |
|---|---|---|---|---|
| 2004/0255541 | A1 | 12/2004 | Thiers et al. | |
| 2005/0034404 | A1 | 2/2005 | Pervan | |
| 2005/0034405 | A1 | 2/2005 | Pervan | |
| 2005/0055943 | A1* | 3/2005 | Pervan | 52/578 |
| 2005/0102937 | A1 | 5/2005 | Pervan | |
| 2005/0138881 | A1 | 6/2005 | Pervan | |
| 2005/0160694 | A1 | 7/2005 | Pervan | |
| 2005/0161468 | A1 | 7/2005 | Wagner | |
| 2005/0166502 | A1* | 8/2005 | Pervan et al. | 52/387 |
| 2005/0166514 | A1 | 8/2005 | Pervan | |
| 2005/0166516 | A1 | 8/2005 | Pervan | |
| 2005/0193675 | A1 | 9/2005 | Smart et al. | |
| 2005/0193677 | A1* | 9/2005 | Vogel | 52/592.1 |
| 2005/0208255 | A1* | 9/2005 | Pervan | 428/60 |
| 2005/0210810 | A1* | 9/2005 | Pervan | 52/578 |
| 2005/0235593 | A1 | 10/2005 | Hecht | |
| 2005/0268570 | A2* | 12/2005 | Pervan | 52/578 |
| 2006/0032168 | A1* | 2/2006 | Thiers et al. | 52/390 |
| 2006/0048474 | A1 | 3/2006 | Pervan | |
| 2006/0070333 | A1 | 4/2006 | Pervan | |
| 2006/0073320 | A1 | 4/2006 | Pervan et al. | |
| 2006/0075713 | A1* | 4/2006 | Pervan et al. | 52/578 |
| 2006/0101769 | A1 | 5/2006 | Pervan | |
| 2006/0117696 | A1 | 6/2006 | Pervan | |
| 2006/0179773 | A1 | 8/2006 | Pervan | |
| 2006/0196139 | A1* | 9/2006 | Pervan et al. | 52/586.1 |
| 2006/0236642 | A1 | 10/2006 | Pervan | |
| 2006/0260254 | A1 | 11/2006 | Pervan | |
| 2006/0283127 | A1* | 12/2006 | Pervan | 52/592.1 |
| 2007/0011981 | A1* | 1/2007 | Eisermann | 52/588.1 |
| 2007/0119110 | A1 | 5/2007 | Pervan | |
| 2007/0175143 | A1* | 8/2007 | Pervan et al. | 52/403.1 |
| 2007/0175144 | A1* | 8/2007 | Hakansson | 52/403.1 |
| 2007/0175148 | A1* | 8/2007 | Bergelin et al. | 52/480 |
| 2007/0175156 | A1* | 8/2007 | Pervan et al. | 52/582.1 |
| 2008/0000179 | A1* | 1/2008 | Pervan et al. | 52/390 |
| 2008/0000180 | A1* | 1/2008 | Pervan | 52/392 |
| 2008/0000182 | A1* | 1/2008 | Pervan | 52/478 |
| 2008/0000186 | A1* | 1/2008 | Pervan et al. | 52/588.1 |
| 2008/0000187 | A1* | 1/2008 | Pervan | 52/588.1 |
| 2008/0000188 | A1* | 1/2008 | Pervan | 52/588.1 |
| 2008/0000189 | A1* | 1/2008 | Pervan et al. | 52/588.1 |
| 2008/0000194 | A1* | 1/2008 | Pervan et al. | 52/745.19 |
| 2008/0000417 | A1* | 1/2008 | Pervan et al. | 118/107 |
| 2008/0005989 | A1* | 1/2008 | Pervan et al. | 52/403.1 |
| 2008/0005992 | A1* | 1/2008 | Pervan | 52/478 |
| 2008/0005997 | A1* | 1/2008 | Pervan | 52/578 |
| 2008/0005998 | A1* | 1/2008 | Pervan | 52/589.1 |
| 2008/0005999 | A1* | 1/2008 | Pervan | 52/589.1 |
| 2008/0008871 | A1* | 1/2008 | Pervan | 428/323 |
| 2008/0010931 | A1* | 1/2008 | Pervan et al. | 52/403.1 |
| 2008/0010937 | A1* | 1/2008 | Pervan et al. | 52/588.1 |
| 2008/0028707 | A1* | 2/2008 | Pervan | 52/391 |
| 2008/0028713 | A1* | 2/2008 | Pervan et al. | 52/586.1 |
| 2008/0034701 | A1* | 2/2008 | Pervan | 52/588.1 |
| 2008/0034708 | A1* | 2/2008 | Pervan | 52/792.11 |
| 2008/0041007 | A1* | 2/2008 | Pervan et al. | 52/506.01 |
| 2008/0041008 | A1* | 2/2008 | Pervan | 52/588.1 |
| 2008/0060308 | A1* | 3/2008 | Pervan | 52/588.1 |
| 2008/0066415 | A1* | 3/2008 | Pervan et al. | 52/588.1 |
| 2008/0104921 | A1* | 5/2008 | Pervan et al. | 52/588.1 |
| 2008/0110125 | A1* | 5/2008 | Pervan | 52/582.2 |
| 2008/0134607 | A1* | 6/2008 | Pervan et al. | 52/395 |
| 2008/0134613 | A1* | 6/2008 | Pervan | 52/582.2 |
| 2008/0134614 | A1* | 6/2008 | Pervan et al. | 52/588.1 |
| 2008/0168730 | A1 | 7/2008 | Pervan | |
| 2008/0168736 | A1 | 7/2008 | Pervan | |
| 2008/0172971 | A1 | 7/2008 | Pervan | |
| 2008/0209837 | A1 | 9/2008 | Pervan | |
| 2008/0209838 | A1 | 9/2008 | Pervan | |

FOREIGN PATENT DOCUMENTS

| | | | |
|---|---|---|---|
| AU | 713628 | | 1/1998 |
| AU | 200020703 | A1 | 6/2000 |
| BE | 417526 | | 9/1936 |
| BE | 0557844 | | 6/1957 |
| BE | 1010339 | A3 | 6/1998 |
| BE | 1010487 | A6 | 10/1998 |
| CA | 0991373 | | 6/1976 |
| CA | 2252791 | | 5/1999 |
| CA | 2226286 | | 12/1999 |
| CA | 2289309 | | 7/2000 |
| CA | 2 363 184 | A1 | 7/2001 |
| CH | 200949 | | 1/1939 |
| CH | 211877 | | 1/1941 |
| CH | 690242 | A5 | 6/2000 |
| DE | 1 212 275 | | 3/1966 |
| DE | 7102476 | | 1/1971 |
| DE | 1 534 278 | | 11/1971 |
| DE | 2 159 042 | | 6/1973 |
| DE | 2 159 042 | A1 | 6/1973 |
| DE | 2 205 232 | | 8/1973 |
| DE | 7402354 | | 1/1974 |
| DE | 2 238 660 | | 2/1974 |
| DE | 2 252 643 | | 5/1974 |
| DE | 2 502 992 | | 7/1976 |
| DE | 2 616 077 | | 10/1977 |
| DE | 2 917 025 | | 11/1980 |
| DE | 30 41781 | A1 | 6/1982 |
| DE | 32 14 207 | A1 | 11/1982 |
| DE | 32 46 376 | C2 | 6/1984 |
| DE | 33 43 601 | A1 | 6/1985 |
| DE | 35 38 538 | A1 | 10/1985 |
| DE | 86 04 004 | | 6/1986 |
| DE | 35 12 204 | A1 | 10/1986 |
| DE | 35 44 845 | A1 | 6/1987 |
| DE | 36 31 390 | A1 | 12/1987 |
| DE | 40 02 547 | A1 | 8/1991 |
| DE | 41 30 115 | A1 | 9/1991 |
| DE | 41 34 452 | A1 | 4/1993 |
| DE | 42 15 273 | A1 | 11/1993 |
| DE | 42 42 530 | A1 | 6/1994 |
| DE | 43 13 037 | C1 | 8/1994 |
| DE | 93 17 191 | U1 | 3/1995 |
| DE | 296 10 462 | | 10/1996 |
| DE | 196 01 322 | A1 | 5/1997 |
| DE | 296 18 318 | U1 | 5/1997 |
| DE | 297 10 175 | U1 | 9/1997 |
| DE | 196 51 149 | A1 | 6/1998 |
| DE | 197 09 641 | A1 | 9/1998 |
| DE | 197 18 319 | A1 | 11/1998 |
| DE | 197 18 812 | A1 | 11/1998 |
| DE | 299 22 649 | U1 | 4/2000 |
| DE | 200 01 225 | U1 | 8/2000 |
| DE | 200 02 744 | U1 | 9/2000 |
| DE | 199 25 248 | A1 | 12/2000 |
| DE | 200 13 380 | | 12/2000 |
| DE | 200 17 461 | U1 | 3/2001 |
| DE | 200 18 284 | U1 | 3/2001 |
| DE | 100 01 248 | | 7/2001 |
| DE | 100 32 204 | C1 | 7/2001 |
| DE | 100 44 016 | A1 | 3/2002 |
| DE | 202 05 774 | U1 | 8/2002 |
| DE | 203 07 580 | U1 | 7/2003 |
| DE | 203 17 527 | U1 | 1/2004 |
| DE | 20 2004 001 038 | U1 | 5/2004 |
| DE | 20 2005 006 300 | U1 | 8/2005 |
| DE | 10 2004 054 368 | A1 | 5/2006 |
| EP | 0 248 127 | A1 | 12/1987 |
| EP | 0 487 925 | A1 | 6/1992 |
| EP | 0 623 724 | A1 | 11/1994 |

| | | | |
|---|---|---|---|
| EP | 0 652 340 | A1 | 5/1995 |
| EP | 0 665 347 | | 8/1995 |
| EP | 0 690 185 | A1 | 1/1996 |
| EP | 0 698 162 | B1 | 2/1996 |
| EP | 0 843 763 | B1 | 5/1998 |
| EP | 0 849 416 | A2 | 6/1998 |
| EP | 0 855 482 | B1 | 7/1998 |
| EP | 0 877 130 | B1 | 11/1998 |
| EP | 0 958 441 | | 11/1998 |
| EP | 0 661 135 | B1 | 12/1998 |
| EP | 0 903 451 | A2 | 3/1999 |
| EP | 0 969 163 | A2 | 1/2000 |
| EP | 0 969 163 | A3 | 1/2000 |
| EP | 0 969 164 | A2 | 1/2000 |
| EP | 0 969 164 | A3 | 1/2000 |
| EP | 0 974 713 | A1 | 1/2000 |
| EP | 0 976 889 | | 2/2000 |
| EP | 1 048 423 | A2 | 11/2000 |
| EP | 1 120 515 | A1 | 8/2001 |
| EP | 1 146 182 | A2 | 10/2001 |
| EP | 1 165 906 | | 1/2002 |
| EP | 1 223 265 | | 7/2002 |
| EP | 1 251 219 | A1 | 10/2002 |
| EP | 1 262 609 | | 12/2002 |
| EP | 1 317 983 | A2 | 6/2003 |
| EP | 1 338 344 | A2 | 8/2003 |
| FI | 843060 | | 8/1984 |
| FR | 1 293 043 | | 4/1962 |
| FR | 2 568 295 | | 1/1986 |
| FR | 2 630 149 | | 10/1989 |
| FR | 2 637 932 | A1 | 4/1990 |
| FR | 2 675 174 | | 10/1992 |
| FR | 2 691 491 | | 11/1993 |
| FR | 2 697 275 | | 4/1994 |
| FR | 2 712 329 | A1 | 5/1995 |
| FR | 2 781 513 | A1 | 1/2000 |
| FR | 2 785 633 | A1 | 5/2000 |
| FR | 2 810 060 | A1 | 12/2001 |
| GB | 240629 | | 10/1925 |
| GB | 424057 | | 2/1935 |
| GB | 585205 | | 1/1947 |
| GB | 599793 | | 3/1948 |
| GB | 636423 | | 4/1950 |
| GB | 812671 | | 4/1959 |
| GB | 1127915 | | 10/1968 |
| GB | 1171337 | | 11/1969 |
| GB | 1237744 | | 6/1971 |
| GB | 1275511 | | 5/1972 |
| GB | 1394621 | | 5/1975 |
| GB | 1430423 | | 3/1976 |
| GB | 2117813 | A | 10/1983 |
| GB | 2126106 | A | 3/1984 |
| GB | 2243381 | A | 10/1991 |
| GB | 2256023 | A | 11/1992 |
| JP | 54-65528 | | 5/1979 |
| JP | 57-119056 | | 7/1982 |
| JP | 57-185110 | | 11/1982 |
| JP | 59-186336 | | 11/1984 |
| JP | 3-169967 | | 7/1991 |
| JP | 4-106264 | | 4/1992 |
| JP | 4-191001 | | 7/1992 |
| JP | 5-148984 | | 6/1993 |
| JP | 6-56310 | | 5/1994 |
| JP | 6-146553 | | 5/1994 |
| JP | 6-320510 | | 11/1994 |
| JP | 7-076923 | | 3/1995 |
| JP | 7-180333 | | 7/1995 |
| JP | 7-300979 | | 11/1995 |
| JP | 7-310426 | | 11/1995 |
| JP | 8-109734 | | 4/1996 |
| JP | 9-38906 | | 2/1997 |
| JP | 9-88315 | | 3/1997 |
| JP | 10-219975 | | 8/1998 |
| JP | 2000-179137 | | 6/2000 |
| JP | P2000 226932 | | 8/2000 |
| JP | 2001-173213 | | 6/2001 |
| JP | 2001 179710 | | 7/2001 |
| JP | 2001 254503 | | 9/2001 |
| JP | 2001 260107 | | 9/2001 |
| JP | P2001 329681 | | 11/2001 |
| NL | 7601773 | | 8/1976 |
| NO | 157871 | | 7/1984 |
| NO | 305614 | | 5/1995 |
| PL | 24931 | U | 11/1974 |
| SE | 372 051 | | 5/1973 |
| SE | 405 141 | | 6/1984 |
| SE | 501 014 | C2 | 10/1994 |
| SE | 502 994 | | 3/1996 |
| SE | 506 254 | C2 | 11/1997 |
| SE | 509 059 | | 6/1998 |
| SE | 509 060 | | 6/1998 |
| SE | 512 290 | | 12/1999 |
| SE | 512 313 | | 12/1999 |
| SE | 0000200-6 | | 7/2001 |
| SE | 0000785 | | 9/2001 |
| SU | 363795 | | 11/1973 |
| SU | 1680359 | A1 | 9/1991 |
| WO | WO 84/02155 | | 6/1984 |
| WO | WO 87/03839 | A1 | 7/1987 |
| WO | WO 92/17657 | | 10/1992 |
| WO | WO 93/13280 | | 7/1993 |
| WO | WO 94/01628 | | 1/1994 |
| WO | WO 94/26999 | | 11/1994 |
| WO | WO 96/27719 | | 9/1996 |
| WO | WO 96/27721 | | 9/1996 |
| WO | WO 96/30177 | A1 | 10/1996 |
| WO | 97/19232 | | 5/1997 |
| WO | WO 97/47834 | | 12/1997 |
| WO | WO 98/22677 | A1 | 5/1998 |
| WO | WO 98/24994 | | 6/1998 |
| WO | WO 98/24995 | | 6/1998 |
| WO | WO 98/38401 | A1 | 9/1998 |
| WO | WO 99/40273 | A1 | 8/1999 |
| WO | WO 99/66151 | | 12/1999 |
| WO | WO 99/66152 | | 12/1999 |
| WO | WO 00/06854 | | 1/2000 |
| WO | WO 00/20705 | A1 | 4/2000 |
| WO | WO 00/20706 | A1 | 4/2000 |
| WO | WO 00/66856 | A1 | 11/2000 |
| WO | WO 01/02669 | A1 | 1/2001 |
| WO | 01/07729 | | 2/2001 |
| WO | 01/51733 | A1 | 7/2001 |
| WO | WO 01/66876 | A1 | 9/2001 |
| WO | WO 01/66877 | A1 | 9/2001 |
| WO | WO 01/75247 | A1 | 10/2001 |
| WO | WO 01/77461 | A1 | 10/2001 |
| WO | 01/96688 | | 12/2001 |
| WO | 01/98603 | | 12/2001 |
| WO | WO 01/98604 | A1 | 12/2001 |
| WO | 02/055809 | A1 | 7/2002 |
| WO | 02/055810 | A1 | 7/2002 |
| WO | 02/060691 | | 8/2002 |
| WO | WO 03/016654 | A1 | 2/2003 |
| WO | WO 03/025307 | A1 | 3/2003 |
| WO | 03/070384 | A1 | 8/2003 |
| WO | 03/078761 | A1 | 9/2003 |
| WO | WO 03/074814 | A1 | 9/2003 |
| WO | WO 03/083234 | A1 | 10/2003 |
| WO | WO 03/089736 | A1 | 10/2003 |
| WO | 03/099461 | A1 | 12/2003 |
| WO | WO 2004/083557 | A1 | 9/2004 |
| WO | 2005/077625 | A1 | 8/2005 |
| WO | 2005/110677 | A1 | 11/2005 |
| WO | 2006/008578 | A1 | 1/2006 |
| WO | 2006/111437 | A1 | 10/2006 |

WO 2006/113757 A2 10/2006

OTHER PUBLICATIONS

Pervan, Darko, et al., U.S. Appl. No. 11/635,633, entitled "Laminate Floor Panels" filed Dec. 8, 2006.
Hakansson, Niclas, U.S. Appl. No. 11/643,881, entitled "V-GROOVE", filed Dec. 22, 2006.
Bergelin, Marcus, et al., U.S. Appl. No. 11/649,837, entitled "Resilient Groove", filed Jan. 5, 2007.
Pervan, Darko, et al., U.S. Appl. No. 11/575,600, entitled "Mechanical Locking of Floor Panels with a Flexible Tongue", filed Mar. 20, 2007.
Pervan, Darko, U.S. Appl. 11/806,478, entitled "Wear Resistant Surface", filed May 31, 2007.
Pervan, Darko, et al., U.S. Appl. No. 11/770,771, entitled "Locking System Comprising a Combination Lock for Panels", filed Jun. 29, 2007.
Pervan, Darko, et al., U.S. Appl. No. 11/775,885, entitled "Mechanical Locking of Floor Panels with a Flexible Bristle Tongue", filed Jul. 11, 2007.
Jacobsson, Jan, et al., U.S. Appl. No. 11/521,439, entitled "Device and Method for Compressing an Edge of a Building Panel and a Building Panel With Compressed Edges", filed on Sep. 15, 2006.
Pervan, Darko, U.S. Appl. No. 11/627,971, entitled "Locking System for Floorboards", filed on Jan. 28, 2007.
Webster's Dictionary, Random House: New York (1987), p. 862.
Knight's American Mechanical Dictionary, Hurd and Houghton: New York (1876), p. 2051.
Opposition EP 0.698,162 B1—Facts-Grounds-Arguments, dated Apr. 1, 1999, pp. 1-56.
Opposition II EP 0.698,162 B1—Facts-Grounds-Arguments, dated Apr. 30, 1999, (17 pages)—with translation (11 pages).
Opposition I: Unilin Decor N.V./V älinge Aluminum AB, communication dated Jun. 8, 1999 to European Patent Office, pp. 1-2.
Opposition I: Unilin Decor N.V./V älinge Aluminum AB, communication dated Jun. 16, 1999 to European Patent Office, pp. 1-2.
FI Office Action dated Mar. 19, 1998.
NO Office Action dated Dec. 22, 1997.
NO Office Action dated Sep. 21, 1998.
Opposition EP 0.877.130 B1—Facts—Arguments, dated Jun. 28, 2000, pp. 1-13.
RU Application Examiner Letter dated Sep. 26, 1997.
NZ Application Examiner Letter dated Oct. 21, 1999.
European prosecution file history to grant, European Patent No. 94915725.9-2303/0698162, grant date Sep. 17, 1998.
European prosecution file history to grant, European Patent No. 98106535.2-2303/0855482, grant date Dec. 1, 1999.
European prosecution file history to grant, European Patent No. 98201555.4-2303/0877130, grant date Jan. 26, 2000.
Communication of Notices of Intervention by E.F.P. Floor Products dated Mar. 17, 2000 in European Patent Application 0698162, pp. 1-11 with annex pp. 1-21.
Response to the E.F.P. Floor Products intervention dated Jun. 28, 2000, pp. 1-5.
Letters from the Opponent dated Jul. 26, 2001 and Jul. 30, 2001 including Annexes 1 to 3.
Communication from European Patent Office dated Sep. 20, 2001 in European Patent No. 0698162, pp. 1-2 with Facts and Submissions Annex pp. 1-18, Minutes Annex pp. 1-11, and Annex I to VI.
Communication from Swedish Patent Office dated Sep. 21, 2001 in Swedish Patent No. 9801986-2, pp. 1-3 in Swedish with forwarding letter dated Sep. 24, 2001 in English.
Välinge, "Fibo-Trespo" Brochure, Distributed at the Domotex Fair In Hannover, Germany, Jan. 1996.
Träindustrins Handbook "Snickeriarbete", 2nd Edition, Malmö 1952, pp. 826, 827, 854, and 855, published by Teknografiska Aktiebolaget, Sweden.
"Träbearbetning", Anders Grönlund, 1986, ISBN 91-970513-2-2, pp. 357-360, published by Institutet for Trateknisk Forskning, Stockholm, Sweden.
Drawing Figure 25/6107 from Buetec Gmbh dated Dec. 16, 1985.
Pamphlet from Serexhe for Compact-Praxis, entitled "Selbst Teppichböden, PVC and Parkett verlegen", Published by Compact Verlag, München, Germany 1985, pp. 84-87.
Pamphlet from Junckers Industrser A/S entitled"Bøjlesystemet til Junckers boliggulve" Oct. 1994, , Published by Junckers Industrser A/S, Denmark.
Pamphlet from Junckers Industrser A/S entitled "The Clip System for Junckers Sports Floors", Annex 7, 1994, Published by Junckers Industrser A/S, Denmark.
Pamphlet from Junckers Industrser A/S entitled "The Clip System for Junckers Domestic Floors", Annex 8, 1994, Published by Junckers Industrser A/S, Denmark.
Fibo-Trespo Alloc System Brochure entitled "Opplæring OG Autorisasjon", pp. 1-29, Fibo-Trespo.
"Revolution bei der Laminatboden-Verl", boden wand decke, vol. No. 11 of 14, Jan. 10, 1997, p. 166.
Kährs Focus Extra dated Jan. 2001, pp. 1-9.
Brochure for CLIC Laminate Flooring, Art.-Nr. 110 11 640.
Brochure for Laminat-Boden "Clever-Click", Parador® Wohnsysteme.
Brochure for PERGO®, CLIC Laminate Flooring, and Prime Laminate Flooring from Bauhaus, The Home Store, Malmö, Sweden.
Darko Pervan, U.S. Appl. No. 09/714,514 entitled "Locking System and Flooring Board" filed Nov. 17, 2000.
Darko Pervan, U.S. Appl. No. 10/768,677 entitled "Mechanical Locking System for Floorboards" filed Feb. 2, 2004.
Darko Pervan et al., U.S. Appl. No. 10/508,198 entitled "Floorboards With Decorative Grooves" filed Sep. 20, 2004.
Darko Pervan, U.S. Appl. No. 10/509,885 entitled "Mechanical Locking System for Floorboards" filed Oct. 4, 2004.
Darko Pervan, U.S. Appl. No. 10/958,233 entitled "Locking System for Floorboards" filed Oct. 6, 2004.
Darko Pervan, U.S. Appl. No. 10/510,580 entitled "Floorboards for Floorings" filed Oct. 8, 2004.
Darko Pervan, U.S. Appl. No. 10/970,282 entitled "Mechanical Locking System for Floor Panels" filed Oct. 22, 2004.
Darko Pervan, U.S. Appl. No. 10/975,923 entitled "Flooring Systems and Methods for Installation" filed Oct. 29, 2004.
Darko Pervan, U.S. Appl. No. 11/008,213 entitled "Metal Strip for Interlocking Floorboard and a Floorbaord Using Same" filed Dec. 10, 2004.
Darko Pervan, U.S. Appl. No. 11/034,059 entitled "Floor Covering and Locking System" filed Jan. 13, 2005.
Darko Pervan, U.S. Appl. No. 11/034,060 entitled "Floor Covering and Locking System" filed Jan. 13, 2005.
Darko Pervan, U.S. Appl. No. 10/906,109 entitled "Locking System and Flooring Board" filed Feb. 3, 2005.
Darko Pervan, U.S. Appl. No. 10/906,356 entitled "Building Panel With Compressed Edges and Method of Making Same" filed Feb. 15, 2005.
Darko Pervan, U.S. Appl. No. 11/092,748 entitled "Mechanical Locking System for Panels and Method of Installing Same" filed Mar. 30, 2005.
Darko Pervan et al, U.S. Appl. No. 11/161,520 entitled "Method of Making a Floorboard and Mehtod of Making a Floor With the Floorboard" filed Aug. 6, 2005.
Darko Pervan et al, U.S. Appl. No. 11/163,085 entitled "Appliance and Method for Surface Treatment of a Board Shaped Material and Floorboard" filed Oct. 4, 2005.
International Search Report issued in PCT/SE2004/001780 (Published as WO 2005/054599 A1 ), Mar. 4, 2005, Swedish Patent Office, Stockholm, SE.
Written Opinion issued in PCT/SE2004/001780 (Published as WO 2005/054599 A1), Mar. 4, 2005, ISA/SE Patent-och registreringsverket, Stockholm, SE.
International Preliminary Report on Patentability issued in PCT/SE2004/001780 (Published as WO 2005/054599 A1), Oct. 14, 2005, IPEA/SE—Patent-och registreringsverket, Stockholm, SE.

* cited by examiner 5b
4a
5b
5b
5b
12
4b
4a
4a
4b
4b
4b
6
10
A
C
10
B
4b
6
P
P
9
P
P
6
6
6
P
5a
6
6
5a
P
6
5a
P
9
6
P
5a
4b
VP
4a
10
VP
4b
4a
VP
4a
4b
VP
9
6
P
12
P
P
12
P
VP 4a
4b
4b
4a
A
C
B
P
P
P P1'
5b
5a
1
P

FLOORBOARD, SYSTEM AND METHOD FOR FORMING A FLOORING, AND A FLOORING FORMED THEREOF

CROSS REFERENCE TO RELATED APPLICATIONS

The present application claims the benefit of U.S. Provisional Application Ser. No. 60/527,771, filed on Dec. 9, 2003, the entire contents of which are hereby incorporated herein by reference.

TECHNICAL FIELD

The invention generally relates to the technical field of locking systems for floorboards. The invention relates to a locking system for floorboards which can be joined mechanically in different patterns, especially herringbone pattern; floorboards and flooring provided with such a locking system; and laying methods. More specifically, the invention relates above all to locking systems which enable laying of above all floating floors in advanced patterns and in different directions.

FIELD OF APPLICATION OF THE INVENTION

The present invention is particularly suitable for use in floating wooden floors and laminate floors, such as massive wooden floors, parquet floors, laminate floors with a surface layer of high pressure laminate or direct laminate. A laminate floor has a surface consisting of melamine impregnated paper which has been compressed under pressure and heat.

The following description of prior-art technique, problems of known systems as well as objects and features of the invention will therefore, as a non-restrictive example, be aimed above all at this field of application. However, it should be emphasised that the invention can be used in optional floorboards which are intended to be joined in different patterns with a mechanical locking system. The invention can thus also be applicable to floors with a surface of plastic, linoleum, cork, varnished fiberboard surface and the like. The mechanically joined floorboards can also be supplemented with gluing to a subfloor.

DEFINITION OF SOME TERMS

In the following text, the visible surface of the installed floorboard is called "front side", while the opposite side of the floorboard, facing the subfloor, is called "rear side". By "horizontal plane" is meant a plane which extends parallel to the outer part of the surface layer. The upper and outer part of the joint edge defines a "vertical plane" perpendicular to the horizontal plane.

By "joint" or "locking system" are meant cooperating connecting means which connect the floorboards vertically and/or horizontally. By "mechanical locking system" is meant that the joining can take place without glue. Mechanical locking systems can in many cases also be joined by gluing. By "vertical locking" is meant locking parallel to the vertical plane and by "horizontal locking" is meant locking parallel to the horizontal plane.

BACKGROUND OF THE INVENTION

Traditional laminate and parquet floors are usually laid floating, i.e. without gluing, on an existing subfloor. Floating floors of this type are usually joined by means of glued tongue and groove joints. The same method is used on both long side and short side, and the boards are usually laid in parallel rows long side against long side and short side against short side.

In addition to such traditional floors, which are joined by means of glued tongue and groove joints, floorboards have recently been developed which do not require the use of glue and instead are joined mechanically by means of so-called mechanical locking systems. These systems comprise locking means which lock the boards horizontally and vertically. The mechanical locking systems can be formed in one piece by machining of the core of the board. Alternatively, parts of the locking system can be formed of a separate material which is integrated with the floorboard, i.e. joined to the floorboard even in connection with the manufacture thereof at the factory. The separate material may consist of an already machined part which is included in the joint system, but it may also be a part which after fastening is formed to a suitable shape. Fastening can take place with glue or mechanically. The floorboards are joined, i.e. interconnected or locked together, by different combinations of angling, snapping-in and insertion along the joint edge in the locked position.

The main advantages of floating floors with mechanical locking systems are that they can easily and quickly be laid by preferably various combinations of inward angling and snapping-in. They can also easily be taken up again and used once more at a different location.

PRIOR-ART TECHNIQUE AND PROBLEMS THEREOF

All currently existing mechanical locking systems and also floors intended to be joined by gluing have vertical locking means which lock the floorboards across the surface plane of the boards. These vertical locking means consist of a tongue which enters a groove in an adjoining floorboard. The boards thus cannot be joined groove against groove or tongue against tongue. Also the horizontal locking system as a rule consists of a locking element on one side which cooperates with a locking groove on the other side. Thus the boards cannot be joined locking element against locking element or locking groove against locking groove. This means that the laying is in practice restricted to parallel rows. Using this technique, it is thus not possible to lay traditional parquet patterns where the boards are joined mechanically long side against short side in a "herringbone pattern" or in different forms of diamond patterns. It is known that floorboards can be made in sizes that correspond to traditional parquet blocks and in A and B design with mirror-inverted joint systems, and that such floorboards can be joined mechanically in a herringbone pattern (WO 03/025307 owner Valinge Aluminium AB) by various combinations of angling and snapping-in. Such floorboards can also, if the locking systems are designed in a suitable manner, be joined in parallel rows. Floorboards can also be designed so that laying in, for instance, a herringbone pattern, with long sides joined to short sides, can be made quickly and easily by merely an angular motion along the long sides. In such laying, a short side can be joined to a long side by the short side, for instance, being folded down upon a long side strip which supports a locking element. This locking element locks the floorboards horizontally. The vertical locking on such a short side is achieved by the boards being joined in a herringbone pattern at 90 degrees to each other. A new board which is laid by angling locks the short side of the preceding board and prevents upward angling. This extremely simple laying method can, however, when laying a herringbone pattern only be provided in one direction. This is a great drawback at the beginning of laying when the space toward the wall cannot be filled with cut-off floorboards which are installed backwards, i.e. in the direction opposite to the laying direction. Such backward laying must then be made by snapping-in the short sides or by removing locking elements so that the boards can be moved together and glued. Otherwise, laying must begin with cut-off floorboards which are difficult to measure and time-consuming to install. Laying of a continuous floor surface covering several rooms requires extensive preparations and measurement since laying can only take place in one direction. Take up occurs in reverse order and practically the entire floor must be taken up if some boards that have been laid at the beginning of the laying are damaged. Such damage easily arises in connection with laying and is not noticed until the entire floor has been laid and cleaned. It would therefore be a great advantage if a herringbone pattern could be laid by merely an angular motion and in different directions.

SUMMARY

The present invention relates to locking systems, floorboards, floors and laying methods which make it possible to install floating floors more quickly and more easily than is known today in advanced patterns, preferably herringbone pattern long side against short side, by merely an angular motion toward the subfloor. Also disassembling can take place more quickly and more easily by a reverse method.

A first objective is to provide rectangular floorboards and locking systems which satisfy the above requirements and make it possible, in connection with installation and take up, to change the direction in which joining and take up of the floorboards can take place.

A second objective is to provide a laying method which facilitates laying in different directions.

A third objective is to provide a flooring which consists of three types of floorboards and which can be laid in advanced patterns in different directions preferably by merely an angular motion or vertical motion toward the subfloor.

The terms long side and short side are used to facilitate understanding. According to the invention, the boards can also be square or alternately square and rectangular, and possibly also have different patterns or other decorative features in different directions. For instance, they may have short sides which are not parallel.

It should be particularly emphasised that the locking systems appearing in this description are only examples of suitable designs. The geometries of the locking systems and the active horizontal and vertical locking means can be designed in many different ways according to prior-art technique, and they can be formed by machining the edges of the floorboard or by separate materials being formed or alternatively machined before or after joining to the joint edge portions of the floorboard.

This objective is achieved wholly or partly by a floorboard, a system and a method according to the appended independent claims, by which the invention is defined. Embodiments are set forth in the appended dependent claims, in the following description and in the drawings.

According to a first aspect, there is provided a rectangular floorboard which is designed to provide mechanical joining of said floorboard with similar or identical, adjacent floorboards, wherein said mechanical joining is achieved by first locking means having a locking groove, and second locking means having a portion projecting beyond a vertical plane defined by an upper joint edge and perpendicular to the principal plane of the floorboard, and supporting a locking element designed to interact with said locking groove when said floorboard is joined with a similar or identical one of said adjacent floorboards. In the floorboard, the first locking means is provided on a first short side of the floorboard, and the second locking means is provided on a second, opposite short side of the floorboard and on both long sides of the floorboard, such that said first short side of the floorboard is connectable only horizontally, i.e. in a direction perpendicular to the respective joint edges and parallel to the principal plane of the floorboards, to both long sides and to the second, opposite short side of the identical floorboard.

Such a floorboard, which below is referred to as a "two-way board", has thus, in contrast to prior-art technique, three sides, one short side and two long sides having the same type of mechanical locking system. The two-way board can be included in a floor together with other types of floorboards and enables a change of the laying direction, which significantly facilitates laying especially when the floor consists of floorboards joined in a herringbone pattern.

A "similar floorboard" is understood to be a floorboard whose locking system is compatible, i.e. connectable, with that of the floorboard being defined, but which may have a different configuration with respect to which locking means are arranged on which long side or short side of the floorboard. Also, such a similar floorboard may have additional locking means, e.g. for providing vertical locking as well.

In a first embodiment of this first aspect, the mechanical joining can take place by a vertical motion toward a previously laid floorboard. In a second embodiment, the projecting portion consists of a strip with a locking element. In a third embodiment, the projecting portion consists of an extension of a tongue groove in the joint edge of the floorboard.

According to a second aspect, there is provided a system for forming a flooring, the system comprising rectangular floorboards which are formed to provide mechanical joining of neighboring joint edges of floorboards forming part of the system. In the system, the floorboards are designed to allow said mechanical joining in a horizontal direction perpendicular to the respective joint edges and parallel to the principal plane of the floorboards between two neighboring short sides, between one of the short sides and a thereto neighboring long side, and between two neighboring long sides. In the system, mechanical joining in said horizontal direction is provided by first locking means provided at a first one of said neighboring joint edges and comprising a locking groove, and second locking means provided at a second one of said neighboring joint edges and comprising a portion protruding outside a vertical plane that is defined by an upper joint edge and that is perpendicular to said main plane of the floorboard, and supporting a locking element designed to interact with said locking groove. The system comprises first and second types of floorboards, on which said first and second locking means are arranged in pairs on opposing short edges and long edges, respectively, wherein the locking means of the first type of floorboard along one pair of opposing joint edges is mirror inverted relative to the corresponding locking means along the same pair of opposing joint edges of the second type of floorboard. The system comprises a third type of floorboard, which is so designed that a first one of its two short edges presents said first locking means and both its long edges and its other short edge presents said second locking means.

Thus, one embodiment of the present invention comprises a locking system and a flooring which is made of a first, second and third type of rectangular, mechanically locked floorboards.

The first and the second type have along their long sides pairs of opposing connecting means for locking together similar, adjoining floorboards in the horizontal direction parallel to the principal plane of the floorboards and in the vertical direction perpendicular to the principal plane, and along their short sides pairs of opposing connecting means which allow locking together of similar, adjoining floorboards in the horizontal direction. The connecting means of the floorboards on the long side are designed so as to allow locking together by an angular motion along the upper joint edge, and the connecting means of the floorboards on the short side are designed so as to allow locking together by an essentially vertical motion. The connecting means of the first type of floorboard along one pair of opposing connecting means are arranged in a mirror-inverted manner relative to the corresponding connecting means along the same pair of opposite edge portions of the second type of floorboard. A floorboard of the third type has a short side which at least can be locked in the horizontal direction to a neighboring short side and two long sides of another floorboard of the same third type and further to a short side and a long side of the first and the second type of floorboards. Moreover, this third type has a short side and two long sides which can be locked to a neighboring short side of a floorboard of the same third type and to a long side and a short side of the first and the second type. The floorboards of the third type, which thus is a two-way board, allow laying in different directions and the floor can also be taken up again from two different directions.

In a first embodiment of this second aspect, the two-way board has on one short side and on the two long sides a mechanical locking system which consists of a projection portion.

In a second embodiment of this second aspect, the two-way board has one short side and two long sides which can be joined by an angular motion to at least one long side of the first and the second type. Moreover, the floorboards are joined in a herringbone pattern long side against short side.

Furthermore, an embodiment of the present invention comprises a method for providing a herringbone patterned flooring by means of a system of rectangular, mechanically joined floorboards, wherein neighboring floorboards are designed for being mechanically joined in a horizontal direction perpendicular to respective joint edges of the floorboards and parallel with a main plane of the floorboards, wherein the floorboards are so designed that said joining is possible between two neighboring short sides, between one of the short sides and a thereto neighboring long side, and between two neighboring long sides, wherein said mechanical joining in said horizontal direction is provided by first locking means provided at a first one of said neighboring joint edges and comprising a locking groove, and second locking means provided at a second one of said neighboring joint edges and comprising portion protruding outside a vertical plane that is defined by an upper joint edge and that is perpendicular to said main plane of the floorboard, and supporting a locking element designed to interact with said locking groove. The system comprises first and second types of floorboards, on which said first and second locking means are arranged in pairs on opposing short edges and long edges, respectively, wherein the locking means of the first type of floorboard along one pair of opposing joint edges is mirror inverted relative to the corresponding locking means along the same pair of opposing joint edges of the second type of floorboard. The method comprises joining the floorboards in different directions in the main plane of the floorboards by means of inwards angling, wherein a first row is formed by joining, long side against short side, floorboards of a third type, which is so designed that a first one of its two short edges presents said first locking means and both its long edges and its other short edge presents said second locking means, wherein at least one second row is formed by joining, long side against short side, floorboards of said first type of floorboards and said second type of floorboards, said second row being joined to said first row, in a first installation direction relative to the first row, and wherein at least one third row is formed by joining, long side against short side, floorboards of said first type of floorboards and said second type of floorboards, said third row being joined to said first row in a second installation direction, opposite said first installation direction, such that each one of said floorboards forming part of said third row is rotated 180° relative to a respective corresponding floorboard forming part of said second row.

According to the embodiment of the invention, only one type of two-way board is used, which is installed in different directions, for changing the direction of laying of two types of mirror-inverted floorboards. This is advantageous since the number of variants in production and stock-keeping can then be reduced.

DESCRIPTION OF PREFERRED EMBODIMENTS

Figures 1A, 1B, 1C:
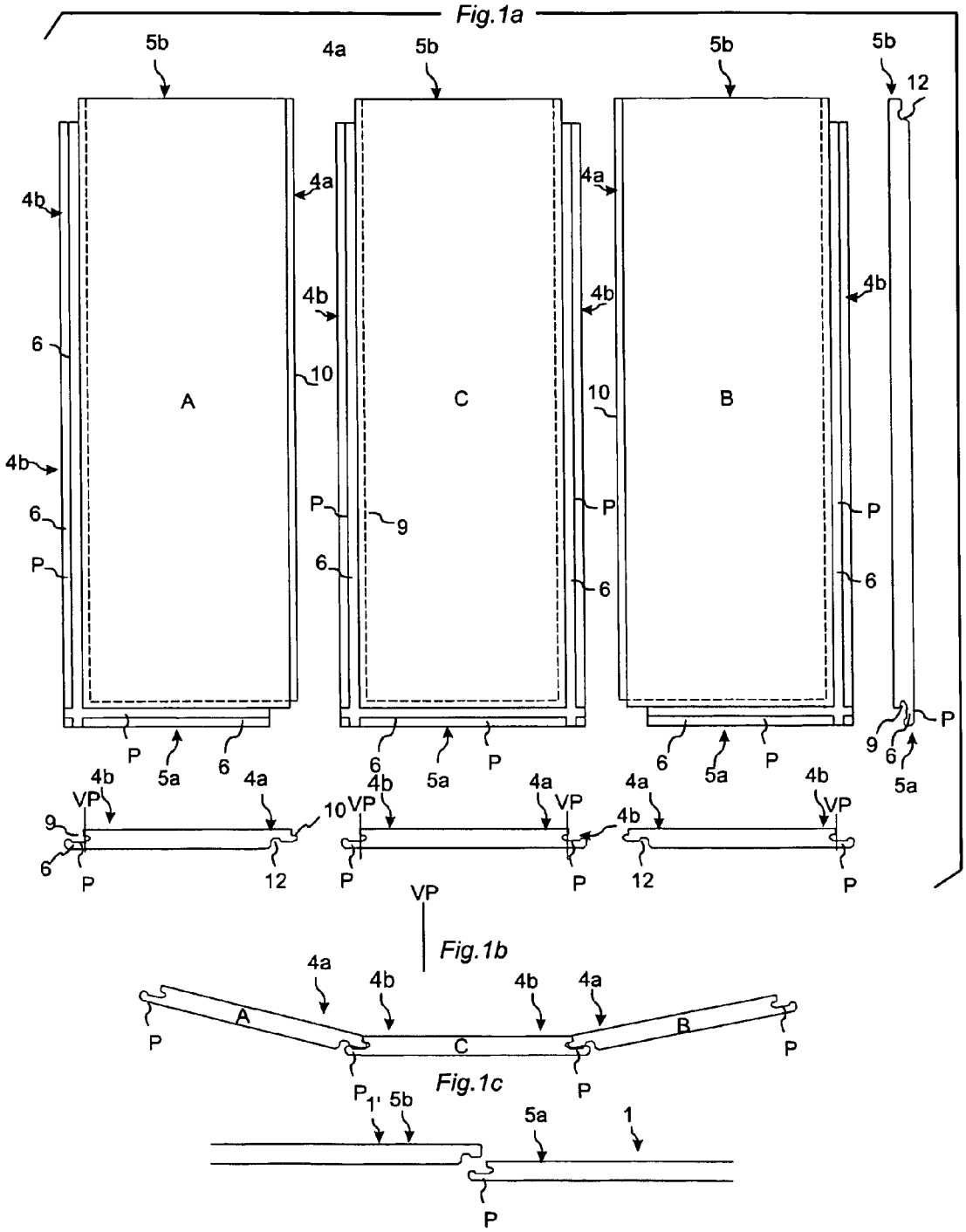
FIGS. 1*a-c* show floorboards according to an embodiment of the invention.

FIG. 1*a* shows 3 rectangular floorboards seen from above, which are of a first type A, a second type B and a third type C according to the invention. FIG. 1*a* also shows the floorboards seen from the side toward the long side and toward the short sides. The floorboards of the types A and B have in this embodiment long sides 4*a*, 4*b* which have vertical and horizontal connecting means and short sides 5*a*, 5*b* which have horizontal connecting means. The connecting means are formed integrally with the floorboard. The two types are in this embodiment identical except that the location of the locking means is mirror-inverted. The locking means allow joining of long side 4*a* to long side 4*b* by at least inward angling and long side 4*a* to short side 5*a* by inward angling and also short side 5*b* to long side 4*b* by a vertical motion. In this embodiment, joining of both long sides 4*a*, 4*b* and short sides 5*a*, 5*b* in a herringbone pattern, i.e. with the boards A and B interconnected perpendicular to each other long side against short side, can take place by merely an angular motion along the long sides 4*a*, 4*b*. The long sides 4*a* and 4*b* of the floorboards have connecting means which in this embodiment consist of a projecting portion P in one long side 4*b*. The projecting portion P is positioned outside the upper joint edge and consists of a strip 6 and a groove 9. The other long side 4*a* has a tongue 10. One short side 5*a* also has a projecting portion P with a strip 6 and a tongue groove 9 while the other short side 5*b* has a locking groove 15 but no tongue 10. In this preferred embodiment the short side 5*b* can only be locked horizontally and not vertically.

The third type C has short sides 5*a* and 5*b* which with respect to the locking function are essentially identical to the first type A and the second type B. Opposite long sides 4*b*, however, are differently formed. They are characterised in that the short sides 5*a*, 5*b* of two such floorboards 1, 1' can be joined to each other and locked in the horizontal direction by a vertical motion, and one short side 5*b* of one board 1 can be joined in the same manner to the two long sides 4*a*, 4*b* of the other board 1'. The mechanical joining consists of a first locking means in one short side 5*b* having a locking groove 12 and a second locking means in the other short side 5*a* having a portion P which projects beyond a vertical plane VP which is perpendicular to the principal plane of the floorboard and defined by the upper joint edge. The floorboards are characterised in that the second locking means with the projecting portion P is positioned on one short side 5*a* and on the two long sides 4*b*. The long sides 4*b* can in this embodiment not be locked to each other and one short side 5*a* cannot be locked to any long side.

In a floor system consisting of all three types of floorboards A, B and C, such floorboards according to the invention can be joined in the following way: The floorboard 1 of the third type C has a short side 5*b* which preferably can be locked in the horizontal direction to a neighboring short side 5*a* and two long sides 4*a*, 4*b* of a floorboard 1' of the same type C and also to a short side 5*a* and one long side 4*b* of the first A and the second type B of floorboards. Moreover the floorboard C has one short side 5*a* and two long sides 4*b* which can be locked to a neighboring short side 5*b* of a floorboard 1' of the same type C and also to a long side 4*a* and to a short side 5*b* of the first A and the second type B. Joining of the above mentioned three essentially identical sides 4*b* and 5*a* of the third type C to the long sides 4*a* of the two mirror-inverted boards of the first A and the second type B can take place by an angular motion, and this joining can take place both in the vertical and in the horizontal direction.

Joining of A and B panels to each other could be made in the following way: The long sides 4*a* could be locked to adjacent long sides 4*b* vertically and horizontally with angling. Joining of the short sides 5*b* to the long and short sides 4*b* and 5*a* which have a projecting portion P, can take place by a vertical motion and the locking is preferably horizontal only.

FIG. 1*b* shows how a long side 4*a* of the two floorboards of type A and B is joined by an angular motion to the projecting portions P of the floorboard of the third type C. After joining, the projecting portions P of the A and B boards are oriented in the opposite direction. This allows subsequently laying in two directions by an angular motion when a new board is joined to a previously laid by being placed upon and angled down toward the projecting portion. Such laying is easier to carry out than in the case where the projecting portion P must be inserted under a previously laid floorboard before inward angling. A change of the laying direction by means of a special two-way board according to the invention can thus be advantageous also when the boards are laid in parallel rows.

FIG. 1*c* shows how a short side 5*b* is placed on a short side 5*a* which has a projecting portion P. Such a vertical motion which causes a horizontal locking can only be made by 5*b* being placed on 5*a*. It is thus not possible to lock the floorboards according to this embodiment by 5*a* with the projecting portion P being placed on 5*b*.

There may be several variants. The two types of floorboards need not be of the same size and the locking means can also be differently shaped.

The connecting means on different sides can be made of the same material or of different materials, or be made of the same material but have different material properties. For instance, the connecting means can be made of plastic, metal, fiberboard-based material and the like. They can also be made of the same material as the floorboard, but may have been subjected to a property-modifying treatment, such as impregnation or the like.

Figure 2A:
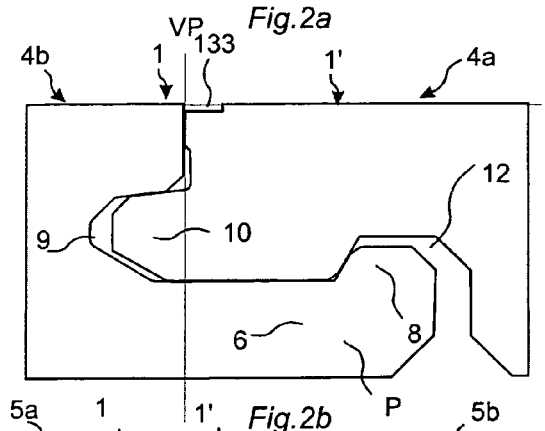
FIGS. 2*a*-2*h* show locking systems on long side and short side.
Figure 2E:
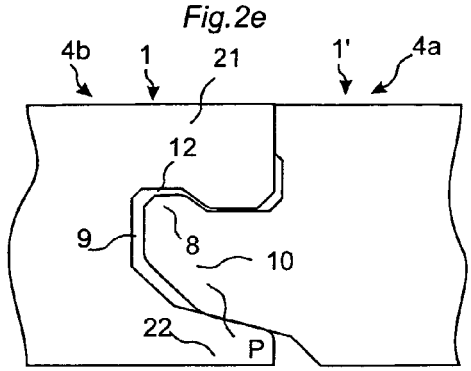
Figure 2B:
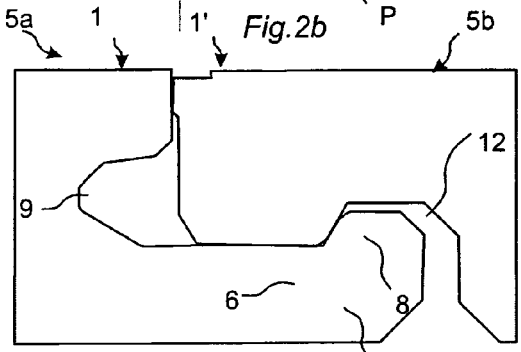
Figure 2F:
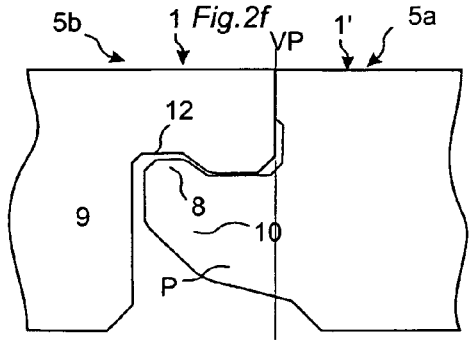
Figure 2C:
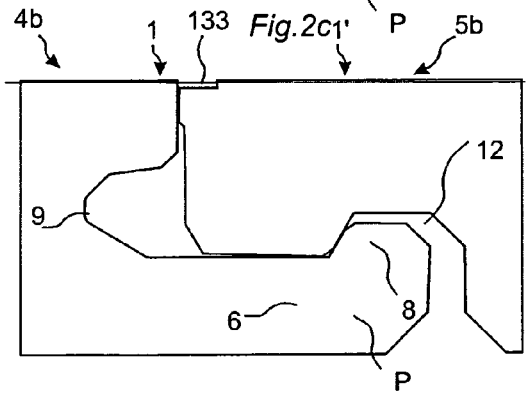
Figure 2G:
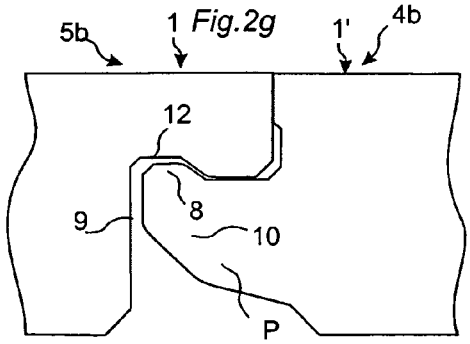
Figure 2D:
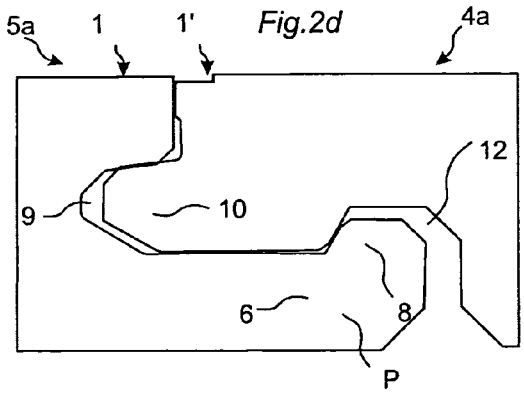

FIGS. 2*a*-2*h* show two embodiments of locking system which can be used to join floorboards according to the invention. It should be particularly pointed out that several other locking systems with corresponding or similar functions can also be used. Nor is it necessary to have the locking function in a projecting portion. Locking can take place on, or inside, the vertical plane VP. As an alternative to joining by an angular motion, snapping-in horizontally or at an angle to the horizontal plane can be used. FIGS. 2*a*-2*d* show in detail the locking system according to FIG. 1. FIG. 2*a* shows the connecting means in two boards 1, 1' which are joined to each other with the long side 4*a* connected to the long side 4*b*. The vertical locking consists of a groove 9 which cooperates with a tongue 10. The horizontal locking consists of a projecting portion P with a strip 6, with a locking element 8 cooperating with a locking groove 12. This joint system can be joined by inward angling along upper joint edges. The floorboards have in one upper joint edge a decorative groove 133 essentially parallel to the floor surface. FIG. 2*b* shows the connecting means on the short side. They consist of a strip 6 with a locking element 8 which cooperates with a locking groove 12 and provides horizontal locking only of the floorboards 1, 1'. The short side 5*a* has a groove 9 which is adapted to cooperate with the tongue 10 of the long side 4*a* when long sides and short sides are locked to each other. The short side 5*b*, however, has no tongue 10. FIG. 2*c* shows how the short side 5*b* is locked to the long side 4*b*. The locking system preferred in FIG. 2*c* can only be joined vertically by a vertical motion such that the short side 5*b*, with its locking groove 12, being placed on a long side or short side having a projecting portion P. FIG. 2*d* shows how the short side 5*a* can be locked to the long side 4*a* vertically and horizontally with a locking system that allows inward angling.

Figure 2H:
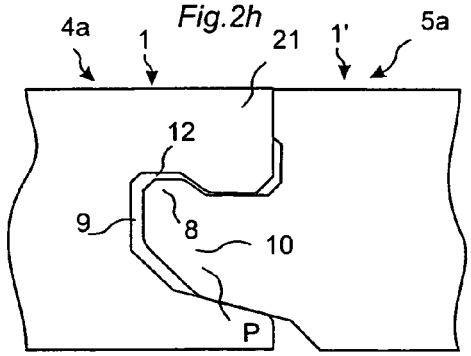

FIGS. 2*e*-2*h* show examples of a locking system in which the projecting portion P instead consists of a tongue 10 which has a locking element 8 in its outer and upper part next to the floor surface in one joint edge of the floorboard 1. The locking system further has a groove 9 with an upper lip 21 and a lower lip 22 and also an undercut groove 12 in the other joint edge of the floorboard 1'. Such a locking system can be made compact and this reduces the waste of material when the tongue 10 is manufactured by machining the joint edge of the floorboard. The waste of material is very important when the floorboards are narrow and short. FIGS. 2*f*-2*h* show how such a locking system can be adapted so that it can joined by merely angling in a herringbone pattern and parallel rows. In this embodiment, the short side 5*b* has no lower lip that prevents vertical locking. The long sides can be joined by angling and the long sides can also be locked to the short sides by angling and vertical folding. Locking using a vertical motion requires also in this case that one side be placed on the projecting portion P.

Figure 3A:
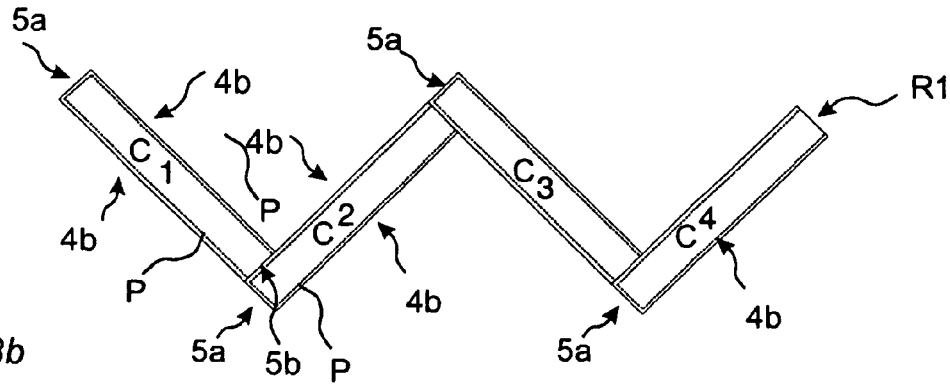
FIGS. 3*a*-3*c* show joining in a herringbone pattern.
Figure 3B:
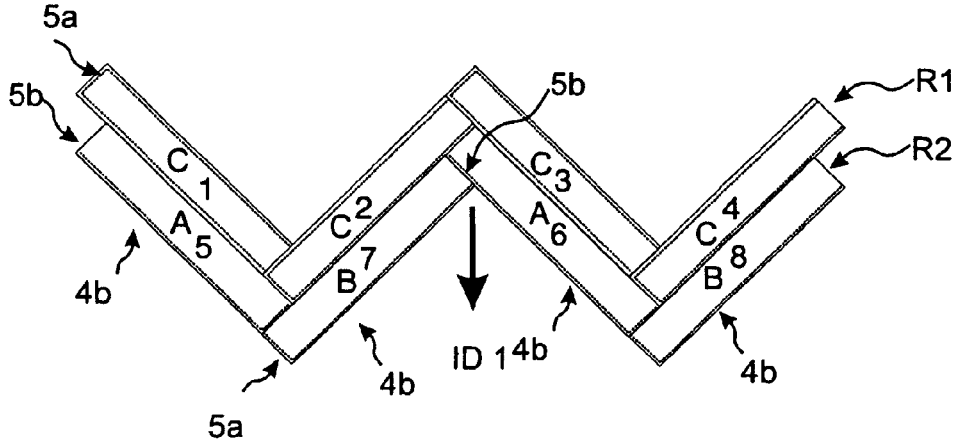
Figure 3C:
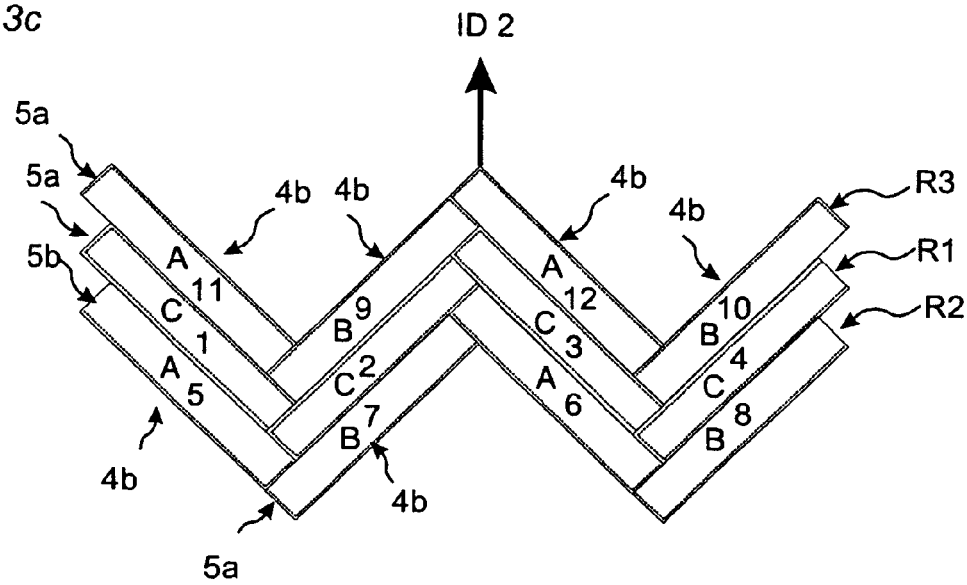

FIGS. 3*a*-3*c* show laying of a floor in a herringbone pattern using merely an angular motion along the long sides and in different directions of laying by using a special floorboard of the third type C. FIG. 3*a* shows how laying of a floor in a herringbone pattern can be begun by a first row R1 being laid with floorboards of the type C. The dashed line indicates the projecting portion P. An identical new board C2 is added to the first laid board C1 in the first row and rotated through 90 degrees and joined with its long side 4*a* to the short side 5*b* of the first laid board. Then the remaining boards C3, C4 are laid in the same way. All boards are interconnected long side against short side by a vertical motion. The boards are only locked horizontally. A new row R2 can now be joined to the first row. The new row R2 consists of the first A and the second B type of floorboards. These can now be joined by an angular motion to the projecting portions B in the first row. A5 and A6 are laid by angling. B7 and B8 can then also be joined by angling, the short side 5*b* of the board B7 being folded down upon the projecting part of the board A6. In the same way, an optional number of rows can be joined in the direction of laying ID1. The floorboards in the second row R2 lock the two-way boards C in the vertical direction when these boards are joined. FIG. 3*c* shows that the laying direction can now be changed to the opposite direction ID2. The boards B9 and B10, which have been rotated through 180 degrees relative to the boards B7 and B8 in the second row R2, can now be installed in a third row R3 against the C boards in the first row R1 by an angular motion. The boards A11 and A12 can be installed correspondingly and laying can continue in the laying direction ID2. This laying method for providing a floor with a herringbone pattern joined by inward angling in different directions and consisting of three types of floorboards A, B and C is characterised by joining a first row R1 long side against short side to floorboards of the third type C, after which at least a second row R2 of floorboards of the first A and the second type B are joined in a direction ID1 to the first row R1 and after that a new row R3 is joined in the opposite direction ID2 to the second row R2, with floorboards of the first A and the second type B which are rotated through 180 degrees relative to the floorboards A, B in the second row R2.

Figure 4A:
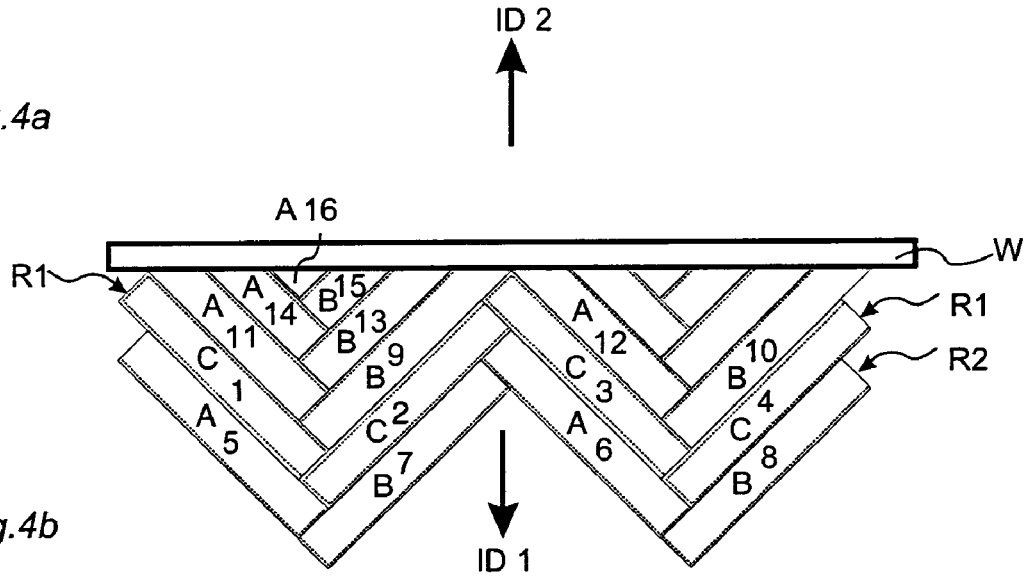
FIGS. 4*a*-4*b* show laying of a floor.
Figure 4B:
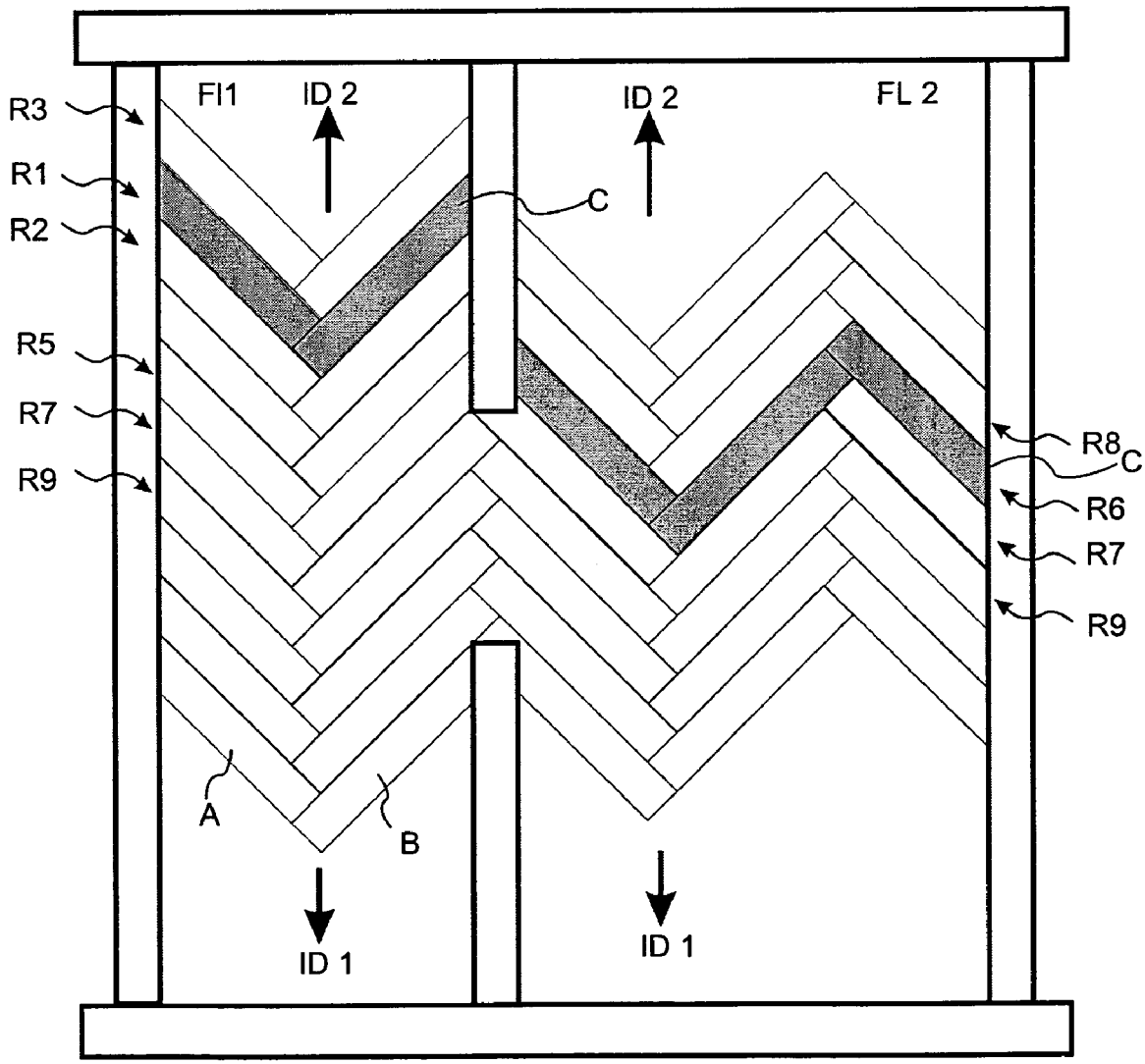

FIG. 4*a* shows how a change of the laying direction can be used to provide simple and quick laying. Laying begins by the first row R2 being laid with two-way boards of the third type C1-C4. Then the two-way boards C are joined to A5, A6 and B7, B8 in the second row R2. The space to the wall W can now be filled with cut-off floorboards A11, A14, A16 and B9, B13 and B15 which can be laid in the direction ID2 and adjusted to the shape of the wall W. Laying can then continue in the original direction ID1. FIG. 4*b* shows how the two-way boards C can be used to simplify laying of a continuous floor covering several rooms FL1 and FL2. Laying begins suitably by the first row R1 being laid using the two-way boards C. Then this row is locked by laying of the second row R2 with A and B boards. Laying can now be made of row R3 and the space to the wall is covered with floorboards. Then laying can continue in the direction ID1 until row R5 is laid. New two-way boards C are now installed in row R6 in room FL2. Then row R7 is laid which locks the two-way boards C. Row R9 can now be installed and the remaining part of the floor in the two rooms FL1 and FL2 can be laid in the direction ID1. The laying of the floor can be terminated by the remaining part of FL2 being laid by laying of row R8 and the remaining rows in the direction ID2.

Two-way boards can also be used to facilitate take-up. If a row of two-way boards is installed, for instance, in the centre of the room, take-up by upward angling can take place from two directions. With prior-art technique, practically the entire floor must be taken up to exchange boards which are installed at the beginning of the laying operation.

Figure 5A:
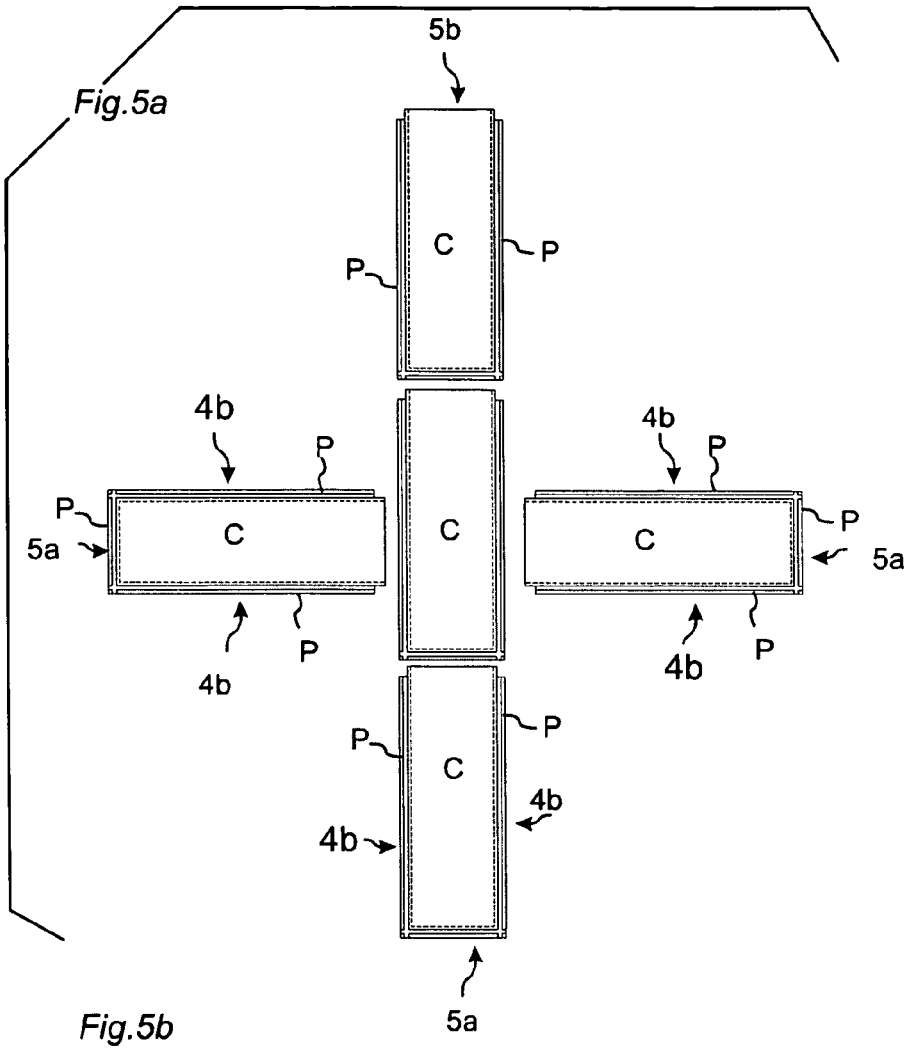
FIGS. 5*a*-5*b* show laying in different directions.
Figure 5B:
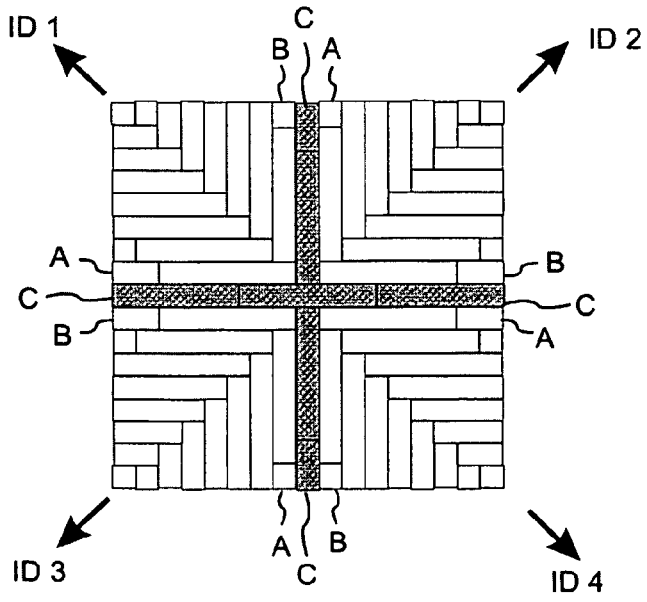

FIG. 5*a* shows how the two-way board C according to the embodiment in FIG. 1 can be joined in a cross. Such joining can be made by a vertical motion. Several alternatives are possible. For instance, the short sides 5*a*, 5*b* can be formed according to FIG. 2*a* or 2*e*. Then they have a tongue that allows joining by an angular motion along upper joint edges and/or an essentially horizontal snapping-in. Also other types of angular and/or snap joints can be used. Alternatively, the short sides can also be joined by insertion along the joint edge. FIG. 5*b* shows how such joining in a cross can be used to provide a floor of two types of floorboards A, B which have mirror-inverted locking systems and which are joined mechanically long side against long side and long side against short side by merely an angular motion. The entire laying starts conveniently in the centre of the cross and can then occur optionally in four directions ID1, ID2, ID3 and ID4. The four parts of the cross are joined to A and B boards. The joining is characterised in that each two-way board C is joined to another two-way board as well as to an A and B board respectively. Take-up can occur in the reverse direction and each floor can thus be taken up in separate portions from four directions. A corresponding laying pattern can, of course, be provided by the long sides being angled and the short sides being snapped to each other. Joining of the long sides can also take place by insertion along the joint edge and/or horizontal or alternatively vertical snapping-in.

Figure 6A:
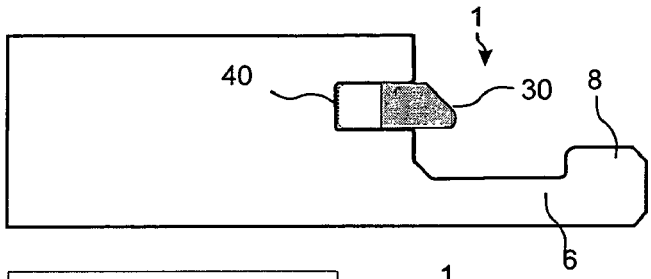
FIGS. 6*a*-6*d* show an embodiment with a flexible tongue.
Figure 6B:
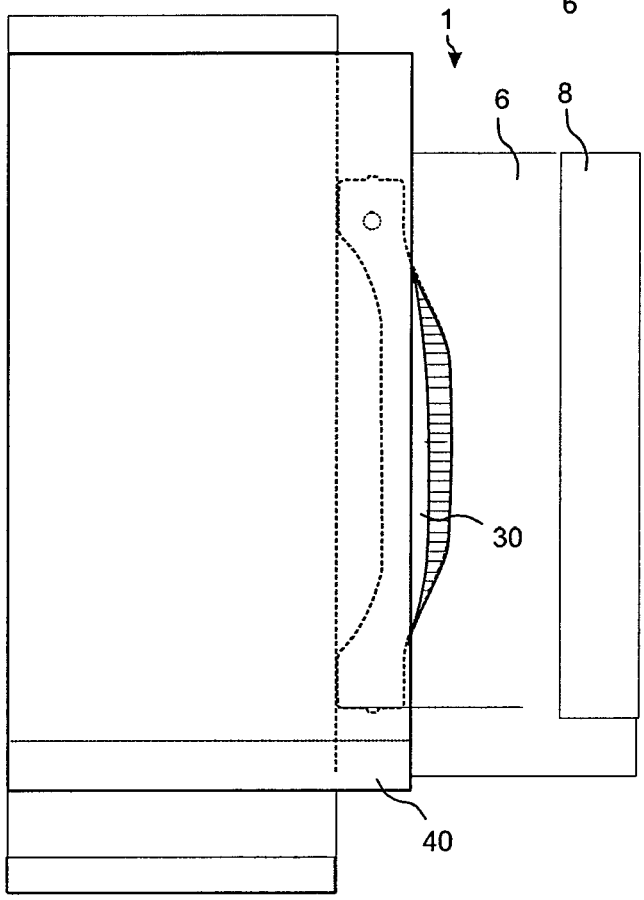
Figure 6C:
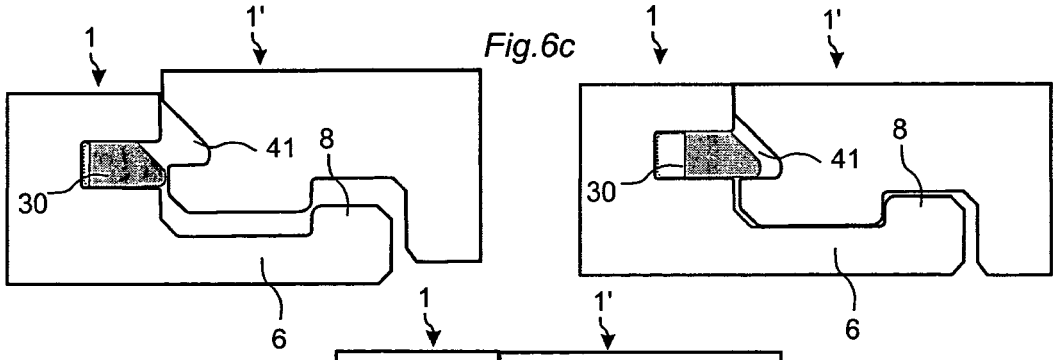
Figure 6D:
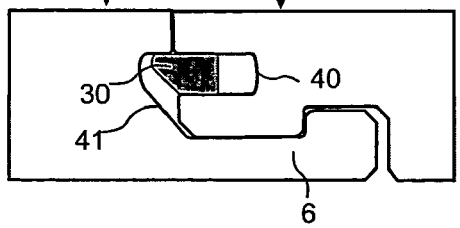

FIGS. 6*a*-6*c* show an embodiment with a flexible tongue 30 in a sliding groove 40 which is preferably formed in the edge of a first panel 1. The flexible tongue is designed to cooperate with a tongue groove 41 of a second similar floor panel 1' in such a way that the second panel could be locked to the first floor panel in vertical and horizontal direction with a simple vertical folding. The flexible tongue 30 and the sliding grove 40 could be formed in the edge of the first panel 1, or as shown by FIG. 6*d*, in the edge of the second panel 1'. The tongue groove 41 is formed in the adjacent edge. The flexible tongue is during the vertical folding displaced two times in the sliding groove. The first displacement is effected by the vertical folding of the second floor panel. A second displacement of the flexible tongue towards its initial position is accomplished substantially by a spring effect caused by the flexible tongue and/or some other flexible device preferably located in the sliding groove. A locking system according to this embodiment could be used for example on the short sides of the A, B and C panels described above in FIG. 1*a*. Preferably the flexible tongue and the sliding grove should be formed on the short sides 5*b*. Such an embodiment with a flexible tongue which allow mechanical locking vertically and horizontally with an angling action, could be used to form a stronger joint in panels where the edges could be deformed vertically when the humidity changes or for instance when the floor is exposed to high load and stress. A floor consisting of A, B, and C panels could be installed with angling only and with all edges connected vertically and horizontally.

Figure 7A:
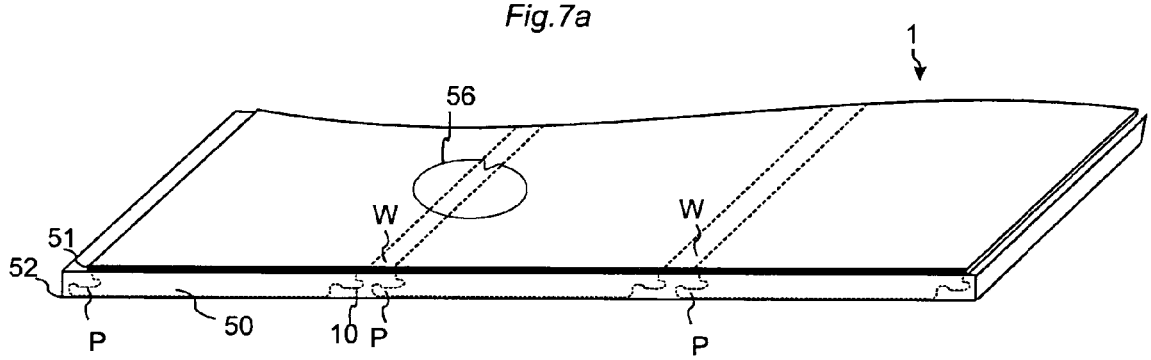
FIGS. 7*a*-7*c* show a cost efficient production with separated surface layer strips.
Figure 7B:
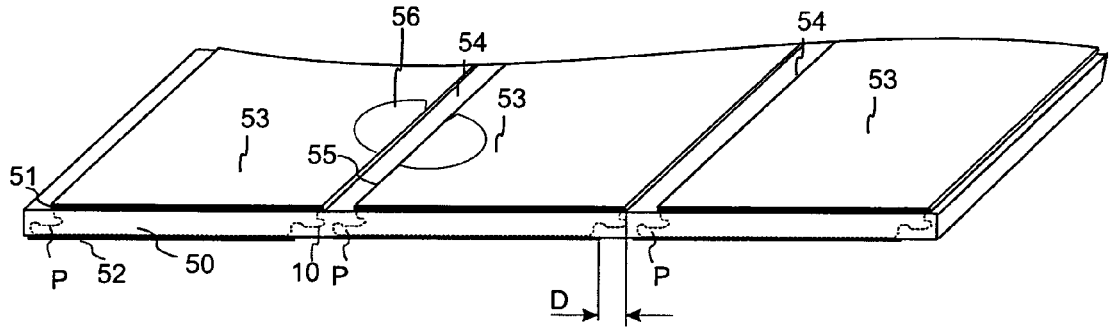
Figure 7C:
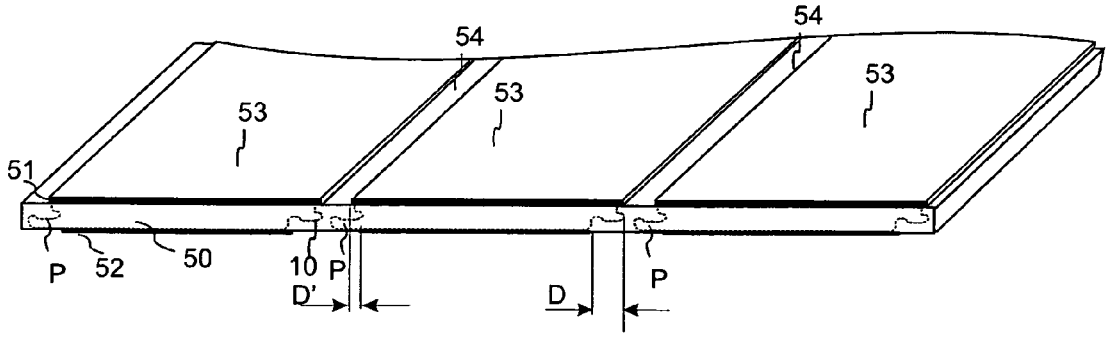

Floor panels according to the invention are especially well suited to be used in floors which consist of rather small and narrow panels. When such floor panels have a surface of for example linoleum, textile, plastic, high-pressure laminate and similar surfaces, which according to known technology are produced in rolls or sheets and glued to a board material such as HDF, particle board and similar wood based panels, the production cost is rather high. The main reason is that a lot of waste is caused in connection with sawing of the semi-finished sheet material 1 and the forming of the locking system, especially on the long sides. This is shown in FIG. 7*a*. The semi-finished sheet material 1 consist of a surface layer 51, a core 50 and preferably a balancing layer 52. Sawing and forming of the projection portion P and the tongue 10 creates a lot of waste W. The objective of this invention is to reduce this waste. This objective is achieved by a production method and a semi-finished sheet or panel. A sheet- or roll formed surface material 51 is separated into surface strips 53 which are glued to the core 50 with a space 54 between the surface strips 53. The surface strips have preferably a width, which is substantially the same as the visible surface of the floor panels. Of course, a small amount of excess material is in most cases needed for the final trimming of the edges. The length of the surface strips could be similar to the length of one or several floor panels. The space 54 consists mainly of board material 50 without a surface layer 51. In most cases the space 54 will consist of a core covered with a glue layer. The same method could be used to save material on the backside. Even the balancing layer 52 could be glued to the core 50 with a space between the strips 53. Preferably the surface layer 51 and the balancing layer 52 are offset horizontally with a distance D in order to save cost. FIG. 7*c* shows that the balancing layer 52 does not have to cover the projecting portion P. The balancing layer could be displaced inwardly on both sides of the surface layer by a distance D, D'. This could give further cost savings especially if the balancing layer is an expensive material such as cork, wood veneer or fibre based material, foam or similar which also could be used for example to reduce sound. This method to separate the surface layer into strips before gluing offers especially the advantage that the surface layer could be punched or cut into surface strips with for example a knife, water jet or similar. Such methods do not create the same waste as for example a 2-3 mm saw blade which is presently used to cut the semi finished sheet 1 into individual panels. The sawing and forming of the locking system creates a loss of surface material and it is therefore difficult to create a pattern which is continuous across a joint of two panels. FIG. 7*a* shows that the pattern 56 will be different after machining of the edges. Cutting with a knife will not give any substantial loss of surface material and the pattern 56 in FIG. 7*b* could be maintained. The edge 55 of the surface strip 53 could be used as a reference surface when machining the edges of a floor panel. With this technology panels could be produced in a cost efficient way and even with patterns, which are substantially continuous over a joint between two panels. As an alternative it is of course possible to glue strips of the surface layer and/or the balancing layer to individual panels and not to a sheet, which is intended to be cut into several individual floor panels.

All the embodiments described above can be combined with each other wholly or partly. The technology with separate surface strips could also be used in connection with direct pressure laminate production where melamine impregnated papers are laminated to a core material. In this case the impregnated papers should be separated into individual strips before the lamination.

The foregoing has described principles, preferred embodiments and modes of operation of the invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the invention as defined by the following claims.

The invention claimed is:

1. A rectangular floorboard which is adapted to provide mechanical joining of said floorboard with similar or identical, adjacent floorboards, the floorboard comprises:

a first locking device having a locking groove, wherein said first locking device does not extend beyond a vertical plane which is perpendicular to a principal plane of the floorboard and defined by the upper joint edge, and a second locking device having a projecting portion projecting beyond the vertical plane defined by the upper joint edge and parallel to the principal plane of the floorboard, and supporting a locking element designed to interact with said locking groove when said floorboard is joined with a similar or identical one of said adjacent floorboards, said first locking device is provided on a first short side of the floorboard, and said second locking device is provided on a second, opposite short side of the floorboard and on both long sides of the floorboard, such that said first short side of the floorboard is lockable only horizontally to both long sides and to the second, opposite short side of the identical floorboard, and thereby lockable only in a direction perpendicular to the respective joint edges and parallel to the principal plane of the floorboards.

2. The floorboard as claimed in claim 1, wherein the floorboard is so designed that mechanical joining can take place by a vertical motion toward a previously laid floorboard.

3. The floorboard as claimed in claim 2, wherein the projecting portion comprises a strip with a locking element.

4. The floorboard as claimed in claim 2, wherein the projecting portion comprises a tongue with a locking element.

5. The floorboard as claimed in claim 2, wherein the projecting portion comprises an extension of a tongue groove.

6. The floorboard as claimed in claim 1, wherein the projecting portion comprises a strip with a locking element.

7. The floorboard as claimed in claim 1, wherein the projecting portion comprises a tongue with a locking element.

8. The floorboard as claimed in claim 1, wherein the projecting portion comprises an extension of a tongue groove.

9. The floorboard as claimed in claim 1, wherein the locking groove of the first locking device has an upper lip, wherein an undercut groove is formed in the upper lip of the locking groove.

10. The floorboard as claimed in claim 1, wherein the protruding portion of the second locking device has an upper surface which supports the locking element designed to interact with the locking groove.

11. A system for forming a flooring, the system comprising rectangular floorboards which are formed to provide mechanical joining of neighboring joint edges of floorboards forming part of the system;

whereby the floorboards are adapted to allow said mechanical joining in a horizontal direction perpendicular to the respective joint edges and parallel to the principal plane of the floorboards between two neighboring short sides, between one of the short sides and a neighboring long side, and between two neighboring long sides;

wherein said mechanical joining in said horizontal direction is provided by a first locking device provided at a first one of said neighboring joint edges which does not extend beyond a vertical plane which is perpendicular to said main plane of the floorboard and defined by the upper joint edge, said first locking device including a locking groove, the locking groove comprising an upper lip, wherein an undercut groove is formed in the upper lip of the locking groove, and a second locking device provided at a second one of said neighboring joint edges and comprising a portion protruding outside the vertical plane that is defined by the upper joint edge and that is perpendicular to said main plane of the floorboard, said protruding portion having an upper surface supporting a locking element designed to interact with said locking groove;

wherein the system comprises first and second types of floorboards, on which said first and second locking devices are arranged in pairs on opposing short edges and long edges, respectively;

wherein the locking devices of the first type of floorboard along one pair of opposing joint edges is mirror-inverted relative to the corresponding locking means along the same pair of opposing joint edges of the second type of floorboard;

the system comprises a third type of floorboard, which is adapted so that a first one of its two short edges presents said first locking device and both its long edges and its other short edge presents said second device.

12. The system as claimed in claim 11, wherein said first and second devices, on at least one of the short edges of the floorboards are adapted so as to allow locking together by a substantially vertical motion.

13. The system as claimed in claim 12, wherein the floorboard of said third type presents a short edge that is joinable in a horizontal direction to, on the one hand, a neighboring short side, and to both long edges of floorboards of said third type of floorboard, and, on the other hand, to a short edge and a long edge of floorboards of said first and second types of floorboards, and wherein the floorboard of said third type presents a short edge and two long edges, which are joinable in the horizontal direction to, on the one hand, a neighboring short edge of floorboards of said third type of floorboard, and, on the other hand, to a long edge and a short edge of floorboards of said first and second types of floorboards.

14. The system as claimed in claim 11, wherein the floorboard of said third type presents a short edge that is joinable in a horizontal direction to, on the one hand, a neighboring short side, and to both long edges of floorboards of said third type of floorboard, and, on the other hand, to a short edge and a long edge of floorboards of said first and second types of floorboards, and wherein the floorboard of said third type presents a short edge and two long edges, which are joinable in the horizontal direction to, on the one hand, a neighboring short edge of floorboards of said third type of floorboard, and, on the other hand, to a long edge and a short edge of floorboards of said first and second types of floorboards.

15. A flooring comprising mechanically joined floorboards, wherein the flooring is composed of floorboards according to the system defined in claim 11.

16. The flooring as claimed in claim 15, wherein the floorboards are joined in a herringbone pattern, long side against short side.

* * * * *